US009458581B1

(12) United States Patent
Schaeding

(10) Patent No.: US 9,458,581 B1
(45) Date of Patent: Oct. 4, 2016

(54) COORDINATED AND PROPORTIONAL GRADE AND SLOPE CONTROL USING GAIN MATRIXES

(71) Applicant: GOMACO Corporation, Ida Grove, IA (US)

(72) Inventor: Chad Schaeding, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 0 days.

(21) Appl. No.: 14/927,257

(22) Filed: Oct. 29, 2015

(51) Int. Cl.

| | |
|---|---|
| ***G06F 7/70*** | (2006.01) |
| ***E01C 23/01*** | (2006.01) |
| ***H04B 7/04*** | (2006.01) |

(52) U.S. Cl.
CPC ..... *E01C 23/01* (2013.01); *H04B 7/0413* (2013.01); *E01C 2301/00* (2013.01)

(58) Field of Classification Search
None
See application file for complete search history.

(56) References Cited

U.S. PATENT DOCUMENTS

| | | | | |
|---|---|---|---|---|
| 4,573,124 | A | 2/1986 | Seiferling | |
| 7,044,680 | B2 | 5/2006 | Godbersen et al. | |
| 7,284,472 | B1 | 10/2007 | Soellner et al. | |
| 7,581,434 | B1 * | 9/2009 | Discenzo | G01N 33/2888 73/53.01 |
| 2004/0176860 | A1 * | 9/2004 | Hovakimyan | G05B 13/027 700/29 |
| 2013/0325184 | A1 * | 12/2013 | Morris | B60W 10/02 700/275 |
| 2014/0041883 | A1 | 2/2014 | Wahlmark | |

* cited by examiner

*Primary Examiner* — Adam Alharbi
(74) *Attorney, Agent, or Firm* — Suiter Swantz pc llo

(57) ABSTRACT

A multiple-input multiple-output (MIMO) computer control system in a heavy equipment machine is in communication with multiple sensors in order to measure deviations from a path to be followed. Sensor corrections are applied to return the heavy equipment machine to a path to be followed or to restrain the machine from deviating from the path to be followed. Sensor corrections affect a controlled variable, such as cross-slope. Sensor corrections may account for false positives and false negatives. Sensor corrections are applied to the heavy equipment machine using a gain matrix (G). The multiple vectors of gain values comprising the gain matrix (G) are utilized by the MIMO computer control system to simultaneously and proportionally actuate each drive leg of the machine to obtain a desired grade including a compensated slope and/or elevation.

20 Claims, 17 Drawing Sheets

402

GT-3600 (3-Track)

CIII (3–track)

CIII 4—Track

COORDINATED AND PROPORTIONAL GRADE AND SLOPE CONTROL USING GAIN MATRIXES

FIELD OF THE INVENTION

The present invention is directed generally toward automatically controlled heavy equipment and construction machinery using elevation or elevation and cross-slope control, including construction machines, and more particularly toward systems for controlling the cross-slope of a paving machine.

BACKGROUND OF THE INVENTION

Construction equipment, including pavers, placers, trimmers, finishers, graders, and many agricultural and mining machines (e.g., harvesters), often require precise control in many directions including azimuthal, vertical (e.g., rise and fall), horizontal, longitudinal, and latitudinal adjustments to obtain a desired grade and/or slope. In order to provide precise control, the equipment may have actuators, including hydraulic cylinders, gears, pulleys, and other implements, in communication with sensors to obtain one or more outputs to apply a moveable force, resulting a desired grade and/or slope.

Current grade control systems of construction equipment are unstable and often difficult to initialize and operate. These systems and configurations often rely on a one-to-one correspondence between sensors and actuators (e.g., Single Input Single Output "SISO" systems), which fail to proportionally account for actuation reciprocity. Failing to account for actuation reciprocity may result in the generation of one or more false output signals and inaccurate or imprecise slope control.

Some advanced systems and configurations may employ a Proportional-Integral-Derivative (PID) controller. Current PID controllers are subject to operator tuning error or cause significant processing and time delays (e.g., gain must be adjusted up or down until operator is satisfied). Responsive slope and elevation control is necessary for curb and gutter work, highway reconstruction, trail paving, some precision agricultural and mining operations, and in circumstances where space and budget is tight. Higher customer expectations require a more responsive control system that can anticipate predictable disturbances.

Consequently, it would be advantageous if an apparatus existed that is adapted to simplify controller tuning, reduce operator error and time delays, cancel out false output signals, and simultaneously and proportionally account for actuation reciprocity.

SUMMARY OF THE INVENTION

Accordingly, the present invention is directed to a novel method and apparatus for controlling construction equipment using a Multi-Input-Multi-Output (MIMO) system to provide simultaneous and proportional actuation to account for actuation reciprocity.

In one embodiment, a control system in heavy equipment machine has a plurality of sensors coupled to the heavy equipment machine having two or more height-adjusting cylinders. In another embodiment, the control system includes a multi-input-multi-output controller (MIMO), the controller includes a processor communicatively coupled to the plurality of sensors and to the two or more height-adjusting cylinders. The processor includes a memory with a set of programmable instructions executable by said processor to: obtain a sensor value for each sensor or a set of sensors of the plurality of sensors; determine a gain matrix (G) using a plurality of sensor correction values; determine a vector of controller outputs for use as actuation inputs for each height-adjusting cylinder based on said gain matrix of said plurality of sensor correction values; and transmit simultaneously each value of the vector of controller outputs to each height-adjusting cylinder to result respective actuation at each height-adjusting cylinder, wherein respective actuation at each height-adjusting cylinder results in a synchronously controlled variable, said synchronously controlled variable including at least one of: cross-slope, right long-slope, left long-slope, or elevation.

In another embodiment, a method for predictive grade and/or slope control is disclosed, the method comprises: obtaining a plurality of controller inputs; determining a plurality of sensor correction values for a plurality of sensors based on said controller inputs; determining a vector of controller outputs based on said plurality of sensor correction values; and transmitting simultaneously each value of the vector of controller outputs to each height adjustable drive leg of a heavy equipment machine having a plurality of height adjustable drive legs to account for sensor error associated with a sensor of said plurality of sensors, wherein the transmitting simultaneously to each height adjustable drive leg results in a synchronously controlled cross-slope, right long-slope, left long-slope, long-slope or elevation of the heavy equipment machine.

In another embodiment, a construction machine is disclosed having a plurality of sensors coupled to two or more elevation cylinders. In another embodiment, a construction machine is disclosed having a multi-input-multi-output (MIMO) controller. In another embodiment, the MIMO controller has a processor communicatively coupled to the plurality of sensors and to the two or more elevation cylinders. In another embodiment, the processor has a memory with one or more programmable instructions executable by said processor to: determine a path to be followed; detect one or more deviations from the path to be followed; obtain a gain matrix (G) based on unique weights given to said plurality of sensors; and determine a vector of controller outputs to simultaneously actuate or restrain actuation at each elevation cylinder of the two or more elevation cylinders, wherein the simultaneous lift at each elevation cylinder results in a synchronously controlled cross-slope, right long-slope, left long-slope, long-slope or elevation of the construction machine to return the construction machine to the path to be followed.

It is to be understood that both the foregoing general description and the following detailed description are for illustrative and explanatory purposes only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1A:
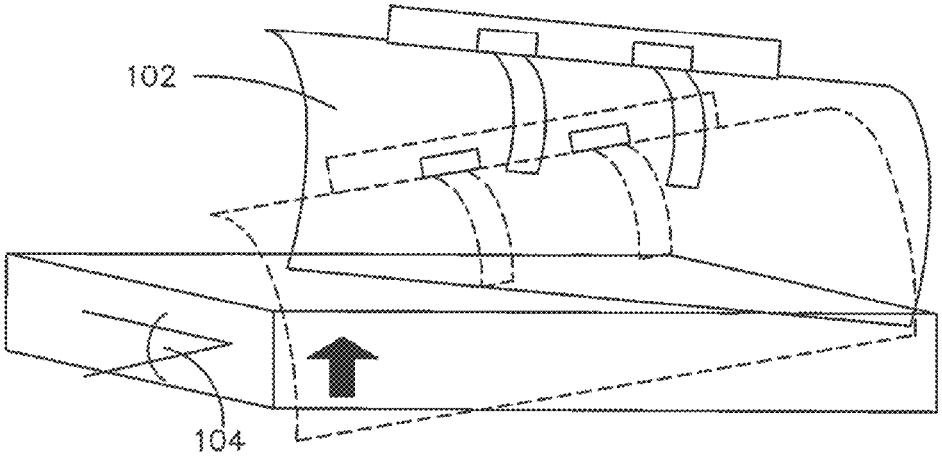
FIGS. 1A-1D show a diagram of a blade of a construction machine using a cross-coupling method of embodiments of the present disclosure.

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

A computer control system in a piece of heavy machinery determines a location, long slope (pitch), cross-slope (roll), and elevation (with respect to a reference surface) of the machine with reference to a plurality of sensors. The long slope, cross slope and elevation are compared to values from a design surface (horizontal alignment, vertical elevation profile, and cross sections) using the location of the machine to query the design data. Sensors are associated with specific drive legs and/or specific controlled variables. In embodiments, multiple sensors may be associated with more than one drive leg. In embodiments, controlled variables (e.g., cross-slope) may have more than one associated sensor. Accordingly sensor values associated with a particular drive leg and/or a particular controlled variable may be averaged to reduce error. Deviations from measured orientation and elevation to the design (desired values) are determined for the machine based on the sensor data. Actuation is applied to the drive legs to account for the deviations from measured orientation and elevation.

The computer control system uses control algorithms that utilize geometrical constraints to predict future deviations and more accurately align the machine, or implements of the machine, based on sensor corrective values. Because multiple sensors are measuring alignment and/or deviations at one time, the computer control system is configured to receive sensor readings as multiple vectors of values, which may be arranged in matrix form. Because the readings from sensors associated with drive legs and/or controlled variables are proportionally affected by interrelated geometrical constraints, predictive correction values are generated by the computer control system. The predictive correction values are applied in gain matrix form by multiplying the predictive correction values by a vector of values (e.g., a vector of sensor values) every loop the controller makes. The predictive correction values thereby bring the actual location, long slope, cross-slope, height, lift, and/or elevation of the machine to within acceptable tolerances of the desired values. The generated predictive correction values decouple future deviations from machine actuation that otherwise would contribute to false positive and/or false negative outputs.

Embodiments of the present disclosure incorporate a multi-input-multi-output (MIMO) control system. A MIMO control system enables an automated, or partially automated, machine to subtract false signals and add synchronizing signals to solve directly for a required lift cylinder correction for a multitude of machine designs, layouts, and configurations.

Embodiments of the present disclosure illustrate inventive concepts utilizing multi-lift-cylinder paving machines. It is noted that the use of paving machines is merely for illustrative and explanatory purposes only, and is not meant to be limiting. A person of skill in the art will recognize that the principles, apparatuses, systems, and methods of this disclosure may be applied to heavy equipment including, but not limited to, engineering machines, construction machines (e.g., pavers, graders, trimmers, finishers, placers, scrapers, etc.), precision agricultural and mining operational machines (e.g., harvesters), and other equipment for which precise controlled variables are desirable. It is further noted that the following notation is used in conjunction with the various paving machine embodiments and examples:

m=number of lift cylinders; n=number of sensors; and t=number of tracks.

In embodiments, a t-track machine may be configured such that m is greater than t. In further embodiments, a t-track machine may be configured such that m is equal to t. In embodiments, a t-track machine may be configured such that n is greater than m and t. In further embodiments, n is equal to m and t. In yet further embodiments, a paving machine may have no tracks (e.g., wheels instead), and thus t is equal to zero.

Embodiments of the present disclosure employ a method to obtain one or more highly accurate grades called a "Predictive Grade Control" (PGC) method. In embodiments, a machine using the PGC method can anticipate grade side disturbances that would, if unaccounted for, cause a future slope error. In embodiments, PGC accounts for grade side disturbances by providing sensor correction values (e.g., determining unique weights to apply to sensors) that accurately and precisely couple desired disturbances at one side to desired disturbances at the other side. For example, if the grade side of a paving machine is determined to need one or more upward lift corrections, then the slope side must also be corrected up (i.e., to maintain a constant slope). In this regard, PGC incorporates feedforward components by anticipating future disturbances caused by outputs. In further embodiments, a machine using the PGC method can predict that due to a particular geometrical constraint, a sensor may be contributing false signals. The control system of the machine ensures such false signals are not relayed to actuatable implements by providing sensor correction values that in essence decouple the false sensor outputs from drive leg outputs. In embodiments, PGC encompasses multiple methods and combinations of methods used in obtaining one or more matrixes of gain values. For example, methods to obtain the gain matrix may include an Inverse method, Quick Inverse method, model predictive control method (MPC), or combinations thereof.

In embodiments, the Inverse method incorporates controlled manipulations of a reference drive leg of the machine to determine the unique weight of each of the sensors. In further embodiments, an internal or "Quick Inverse" method is employed. For example, a controller of a machine utilizing the Quick Inverse method may be configured to perform substantially all the steps of the method (e.g., record sensor values, invert a matrix A, and cache and/or store the computed sensor gain elements for a matrix G). In some embodiments, an external "Off Machine" Inverse method is employed. For example, a field service technician or factory technician may set the sensor gain values based on a rigid (e.g., typical or default) machine configuration.

In embodiments, the MPC method incorporates a model of the machine, including geometrical and logical constraints of the machine to determine the unique weight of each of the sensors. In embodiments, the model of the machine is adjusted during real-time operation (e.g., to account for width expansions). In this regard, the controller is configured to conduct one or more recalculations based on the new geometrical constraints (e.g., due to the width expansion). For example, the one or more recalculations may include recalculating unique sensor weights. By way of another example, the one or more recalculations may include recalculating another gain matrix.

Embodiments of the present disclosure are directed toward obtaining one or more precise controlled variables. The one or more precise controlled variables include, but are not limited to, cross-slope, right long-slope, left long-slope, long-slope, and/or elevation (e.g., rise and fall with respect to a surface). Some embodiments focus on obtaining a precise cross-slope controlled variable only, while other embodiments focus on obtaining a precise elevation controlled variable only. It is noted that the particular controlled variable(s) obtained is merely for illustrative and explanatory purposes only and is not meant to be limiting. A person of skill in the art will recognize that the principles, apparatuses, systems, and methods of this disclosure may be applied to obtain various controlled variables and/or various combinations of controlled variables, including but not limited to, two or more of cross-slope, long-slope, right long-slope, left long-slope, proportional leg stroke, and elevation.

"Actuation reciprocity" is used throughout the present disclosure to represent the simultaneous, reactive effects that may occur (e.g., future disturbances) at other implements (e.g., hydraulic lift cylinders) as a result of actuating or manipulating (e.g., via controller outputs) an implement of a piece of heavy machinery. For example, a hydraulic valve may be opened to produce hydraulic lift to a hydraulic lift cylinder of a reference drive leg of a multi-lift-cylinder paving machine. The hydraulic lift applied to the paving machine may be detected by and impact one or more sensors associated with the reference drive leg, an array of sensors associated with a controlled variable, or each elevation/grade sensor associated with the paving machine. A second (e.g., third, fourth, etc.) drive leg of the multi-lift-cylinder paving machine may also have one or more sensors associated with it. The lift produced at the reference drive leg may impact the one or more sensors associated with each additional drive leg of the multi-lift-cylinder paving machine to a degree corresponding to the height the reference drive leg was lifted. Thus, any sensor(s) associated with each drive leg and each controlled variable may be impacted proportionally according to the degree/amount the reference drive leg is lifted.

"Geometrical sensor relativity" is used throughout the present disclosure to represent the reactive effects (e.g., sensor readings) that occur at a sensor as a result of controller outputs (e.g., lift applied to a drive leg) being related (e.g., proportional) to the geometrical associations of the sensor with the drive legs, other sensors, and/or a reference point or line used to align a machine designed to follow a predetermined path. For example, a sensor, or a set of sensors, may be positioned in close proximity to a machine reference point or line (e.g., stringline) or the sensor may positioned farther away from the reference point or line. The controller of the machine may input or receive sensor readings from the sensor or set of sensors and actuate a hydraulic lift cylinder according to the received sensor readings, which are affected by the position of the sensor. If the geometrical sensor relativity of a sensor is unaccounted for, the actuation according to the received sensor readings (e.g., sensor error values) may produce or contribute to a false output.

Embodiments of the present disclosure account for actuation reciprocity and geometrical sensor relativity by configuring a MIMO controller to anticipate future disturbances, determine a matrix of sensor gain values, process the matrix, and transmit a vector of outputs (e.g., an output to each height-controlling implement) to obtain synchronous and proportional control of drive legs and one or more controlled variables (e.g., cross-slope, elevation, etc.).

Figure 1B:
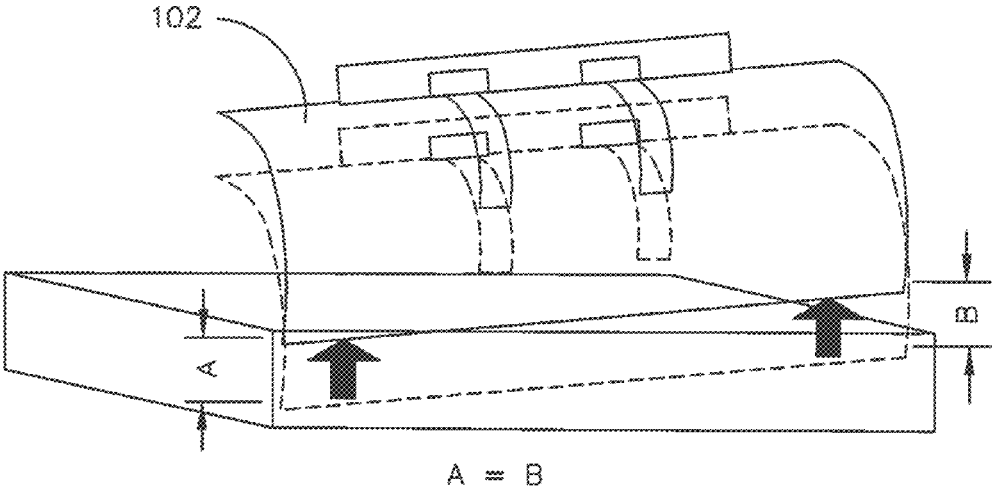

In embodiments, the outputs produced to obtain the synchronous and proportional control of drive legs and one or more controlled variables will be proportional to a controlled manipulation received at a reference height-controlling implement. In embodiments, the controlled manipulation received initializes aligning the machine or a machine implement with a predetermined path (e.g., a predetermined grade or path to be followed). For example, as illustrated in FIGS. 1A-1B, a blade 102 is lifted to obtain a predetermined paving grade. As seen in FIG. 1A, a deviation from the paving path may be detected by a machine controller or an operator. Thus, a correction (e.g., lift) will be applied, by the controller or the operator. For instance, a simplified representation of the relationship may be given by the following formula:

$$c=D-d$$

where D is a design profile value, d is the detected deviation value, and c is the correction value needed to return the machine to the desired paving path.

An illustrative example of determining an elevation profile to help determine a paving grade is found in U.S. Pat. No. 7,044,680 B2, issued on May 16, 2006, which is incorporated by reference herein in its entirety.

If actuation reciprocity is not accounted for, as in FIG. 1A, then after a height change (e.g., leg stroke) only one side of the blade may be lifted in order to conform to the desired paving path, resulting in angle 104 and a change in slope. Using methods and systems of the present disclosure, actuation reciprocity is accounted for such that implements (e.g., height adjustable drive legs or elevation cylinders) responsible for a controlled variable (e.g., the cross-slope in FIGS. 1A and 1B) are simultaneously and proportionally actuated (e.g., cross-coupled) based on an initial height adjustment (e.g., leg stroke). In embodiments, this parallel movement of the blade achieves the more accurate, required controlled variable (e.g., cross-slope) and allows for substantial faster control, as seen in FIG. 1B. In this regard, the parallel movement in FIG. 1B properly accounts for a false negative output (e.g., an outcome that may occur in a SISO system where a controller indicates that a lift cylinder of an implement—the blade 102 in FIG. 1A—is not in need of a height adjustment, when in fact it does need an adjustment).

Figure 1C:
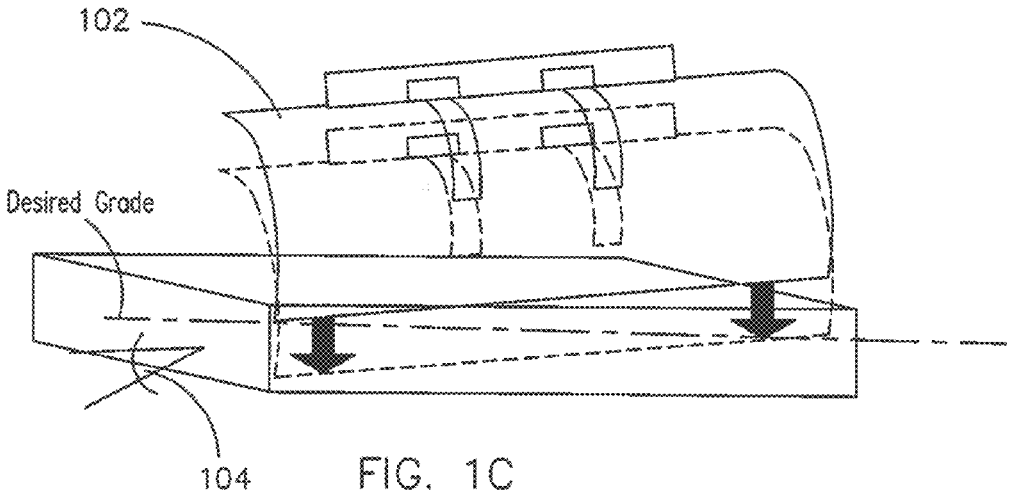
Figure 1D:
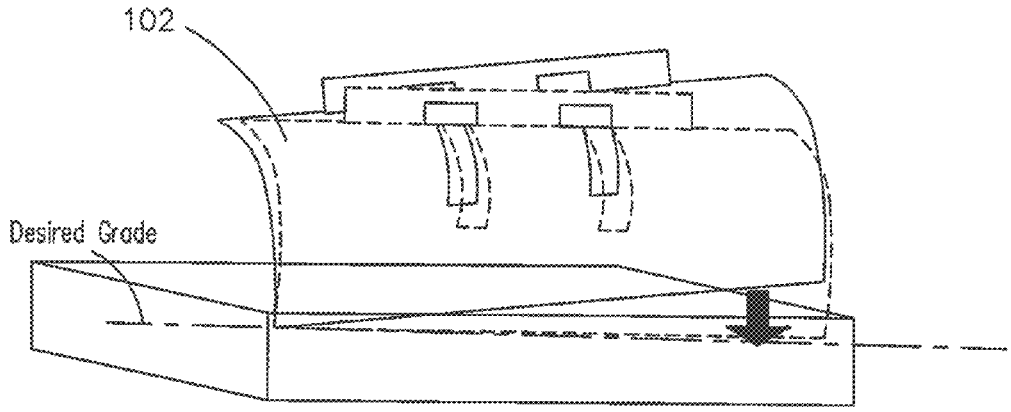

Embodiments of the present disclosure also account for geometrical sensor relativity to reduce, minimize, or eliminate false positives (e.g., an indication that an implement needs a height adjustment, when in fact it does not). For example, referring to FIGS. 1C and 1D, blade 102 is being used to remove material to obtain a desired grade. Due to one or more sensor errors being unaccounted for (e.g., as with a SISO system) or improperly accounted for (e.g., an unweighted sensor output), both sides may move down (e.g., FIG. 1C), when only one side was in need of a height adjustment to obtain the desired grade. This false positive output results in an undesirable angle and a change in slope. False positives (e.g., as in FIG. 1D) and false negatives can be avoided by configuring a MIMO controller to properly account for actuation reciprocity and geometrical sensor relativity and thus reduce the sensor error associated with each sensor contributing to the actuation (e.g., rise and fall) of a height adjustable cylinder.

It is noted that the use of blade 102 in FIGS. 1A-1D is merely for illustrative and explanatory purposes. In embodiments, the concepts and advantages illustrated in FIGS. 1A-1D may be useful for a trimmer, a grader, a finisher, a placer, a paver, a harvester, or any other machine requiring a precise and accurate cross-slope, elevation, and/or long-slope.

Embodiments of the present disclosure illustrate paving machines incorporating the PGC method in a control system to account for actuation reciprocity and sensor geometrical relativity, and thereby maintain a compensated elevation and/or slope control. In embodiments, "2-track," "3-track," "4-track," . . . "t-track" is used. This notation (e.g., "t-track") is used only to refer to the type of paving machine with which the structure and methods of the present disclosure are implemented (with t being the number of tracks). For example, the use of a 3-track paving machine does not imply that the paving machine is limited to the use of tracks as a primary motive means. Rather, wheels or some other motive means may be interchanged with the tracks. Further, it is noted that although the machine may have t-tracks, this does not limit the number of lift cylinders that may be associated with a track of the machine. For instance, a 3-track paving machine may have two or more lift cylinders associated with each track of the three tracks.

Figure 2A:
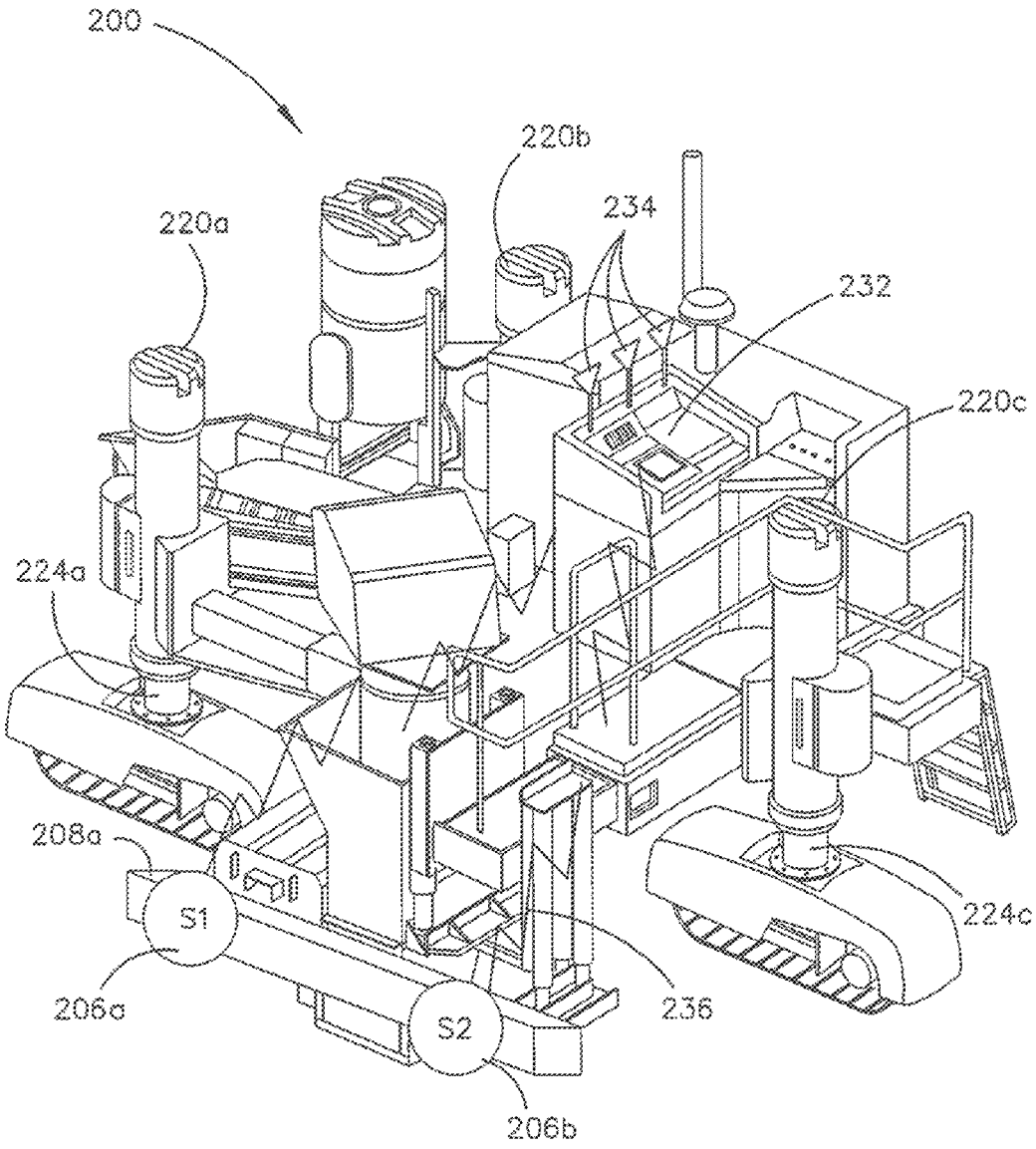
FIGS. 2A-2B show perspective views of an illustrative example of a multi-lift-cylinder (e.g., 3-track) paving machine according to embodiments of the present disclosure.
Figure 2B:
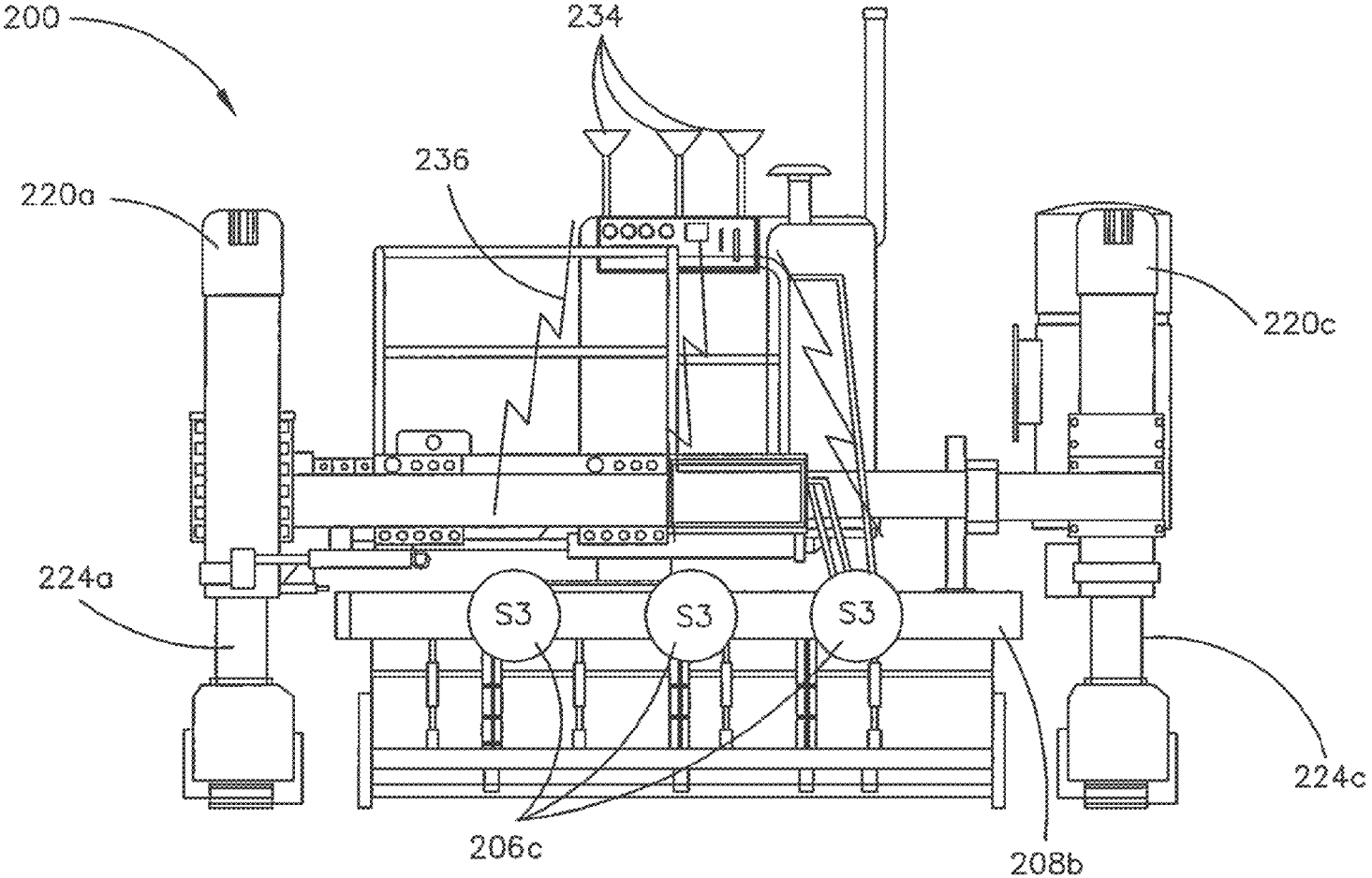

Referring to FIGS. 2A-2B, a block diagram of a 3-track multi-lift-cylinder paving machine 200 comprising multiple sensors 206*a*, 206*b*, and 206*c*, and a controller 232 in communication with the multiple sensors 206*a*, 206*b*, and 206*c* (e.g., using sensor communication network 236), is illustrated.

The hydraulic lift cylinders 224 not only provide lift to an associated drive leg 220, but also measure the amount of lift provided. In this regard, although not shown in FIGS. 2A-2B, each of the hydraulic lift cylinders 224 (e.g., 224*a*, 220*b*—not shown, and 224*c*) will have an inner sensor to measure lift produced by each hydraulic cylinder 224 of each drive leg 220. An illustrative embodiment of one such hydraulic cylinder is found in U.S. Pat. No. 7,284,472, issued on Oct. 23, 2007, which is incorporated by reference herein in its entirety. In embodiments, a controller 232 is in communication with the hydraulic lift cylinders 224, the sensors of the hydraulic lift cylinders 224, and the sensors 206*a*, 206*b*, and 206*c* in order to maintain a predetermined path to be paved. In embodiments, a drive leg 220 incorporating a hydraulic cylinder 224 is referred to herein as a height adjustable drive leg. In further embodiments, the term "elevation cylinder" may refer to the hydraulic cylinder 224 of a height adjustable drive leg, however, it may also refer to a hydraulic cylinder that provides lift to a particular implement (e.g., a blade of a construction machine).

In embodiments, outputs are recorded to create a track-profile (e.g., a path to be followed). In embodiments, the outputs include, but are not limited to, outputs obtained in determining an elevation profile (e.g., knowing how much a leg should be moved, as found in U.S. Pat. No. 7,044,680 B2—referenced above), outputs generated in order to provide lift to each drive leg 220 (e.g., how much the leg has moved, as found in U.S. Pat. No. 7,284,472), outputs including the x- and y-distances of each drive leg (y-distance being proportional or equal to leg stroke), or combinations thereof. The track profile providing information including, but not limited to, an indication of the smoothness of the surface under each drive leg of a multi-lift-cylinder machine.

In embodiments, the paving machine 200 follows a predetermined path according to stringline positioning and generates one or more signals when a deviation from the predetermined path occurs. The one or more signals are provided to the MIMO controller 232 in order to generate corrective adjustments to the height adjusting cylinders (e.g., 224*a*, 224*b*, and 224*c*) in accordance with the signaled deviations. In embodiments, the deviation signals may be provided to alert an operator that a deviation from a path to be paved occurred. In further embodiments, the controller 232 is adapted to follow a path to be paved according to stringless paving. In this regard, the MIMO controller 232 incorporates one or more processors having processes or algorithms capable of delivering position and orientation information to each leg 220 of the multi-lift-cylinder paving machine 200 with a sufficient degree of accuracy. The processes or algorithms of the controller 232 may include GPS, RTK, laser leveling, photogrammetry (including photo-topography and video-gammetry), prism and total station processes and algorithms, machine vision, or any other processes, algorithms, or combination of processes and algorithms for relating the position and orientation of the legs of a multi-lift-cylinder paving machine 200 to the path to be paved.

Embodiments of the present disclosure utilize multi-path transmission and multi-path reception by incorporating a control system with a controller (e.g., 232) and controller interface capable of receiving multiple inputs and transmitting multiple outputs simultaneously. In further embodiments, multiple controller interfaces are used in order to increase control system communication bandwidth, communication speeds, communication accuracy, and to further enable receiving/transmitting multiple respective inputs/outputs simultaneously. An interface includes the components necessary to enable communication between the controller and a wired or wireless transmission medium. The controller interface includes one or more controller area network (CAN) buses. Generally, an increase in the number of CAN buses equates to an increase in the overall bandwidth of the interface. For example, adding a second CAN bus may increase the baud rate from 125,000 bits/second to 250,000 bits per second. In embodiments, the wired or wireless transmission medium may include any number of communication systems and a variety of communication channels, including but not limited to, magnetic media, wired, wireless, fiber, copper, and other types as well.

Figure 3A:
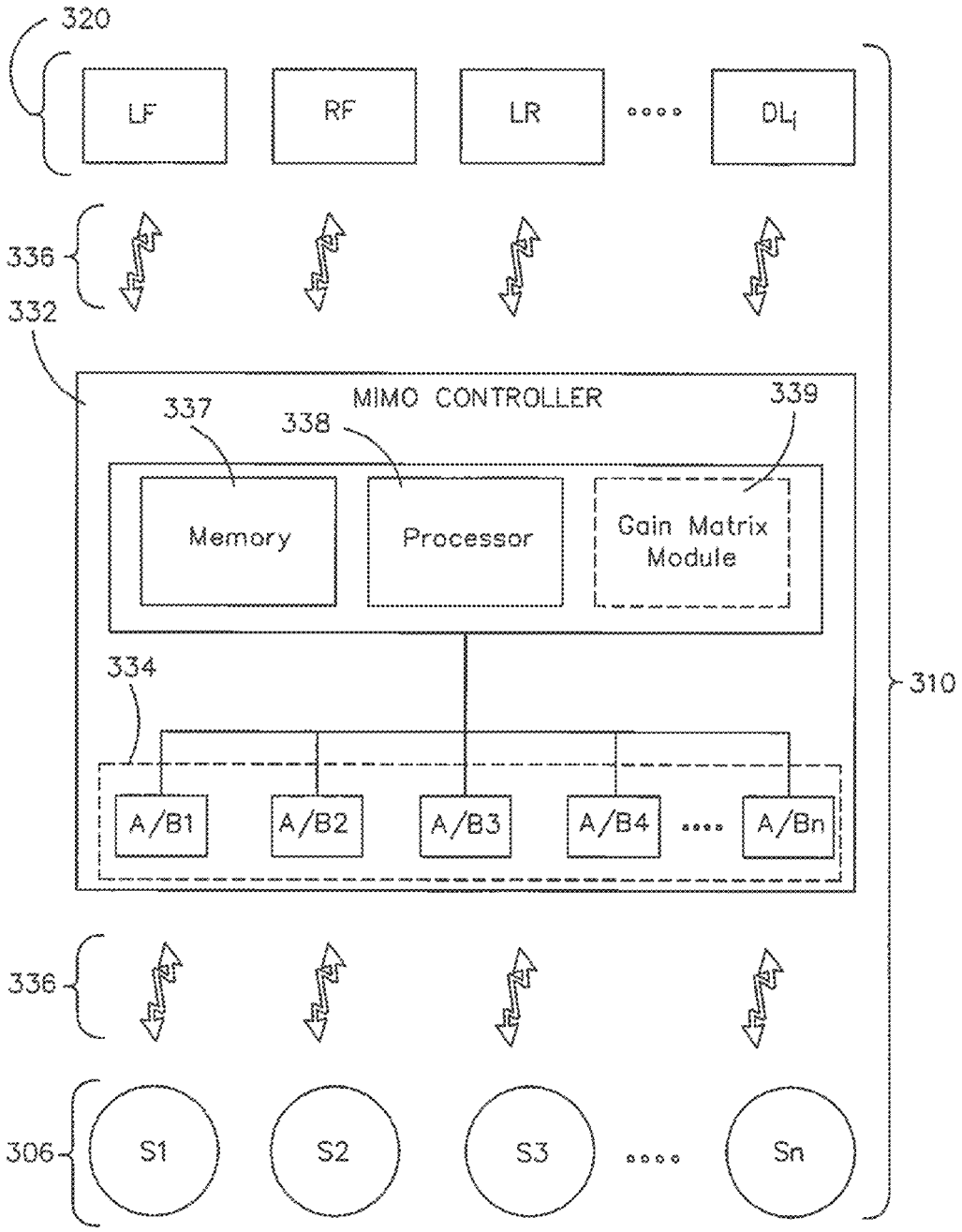
FIGS. 3A-3B show block diagrams of a control system according to embodiments of the present disclosure.

Referring to FIG. 3A, a block diagram of an embodiment of a MIMO control system 310 of the present disclosure is shown. The MIMO control system 310 according to at least one embodiment of the present invention includes the height adjustable drive legs 320 of a multi-lift-cylinder construction machine (e.g., paving machine), a MIMO controller 332, sensors 306, and a sensor network communication connection means 336.

In embodiments, the sensor network communication connection means 336 includes a sensor controller area network (CAN) connection. However, it is recognized that other communication connection means may be utilized, including but not limited to, a wireless local area network connection (WLAN), a wireless personal area network connection (WPAN) such as infra-red and Bluetooth, a wired network communication connection, and other communication connection means known in the art. In embodiments, a machine includes a separate machine network communication connection means for communicatively connecting the machine components (e.g., actuators, prime mover, hoppers, vibrators, steerable tracks, etc.). In embodiments, the machine network communication connection means utilizes a CAN connection. In further embodiments, the sensor CAN connection 336 utilizes the machine CAN (e.g., it is a component of the machine CAN).

In embodiments, the MIMO controller 332 includes a memory 337, a processor 338, and a gain matrix module 339. The processor 338 is configured to execute computer executable program code stored in memory 337 connected to the processor 338. In embodiments, processor 338 may comprise two or more processors. In embodiments, the gain matrix module 339 may include a separate processor (not shown) to perform computer executable code/instruction in order to initiate and/or propagate one or more methods of this disclosure. In embodiments, the MIMO controller 332 is in communication with the sensors 306 (e.g., S1, S2, S3, through Sn) of a multi-lift-cylinder paving machine (e.g., machine 200) and sensors associated with drive legs 320 (e.g., inner drive leg sensors).

Figure 5:
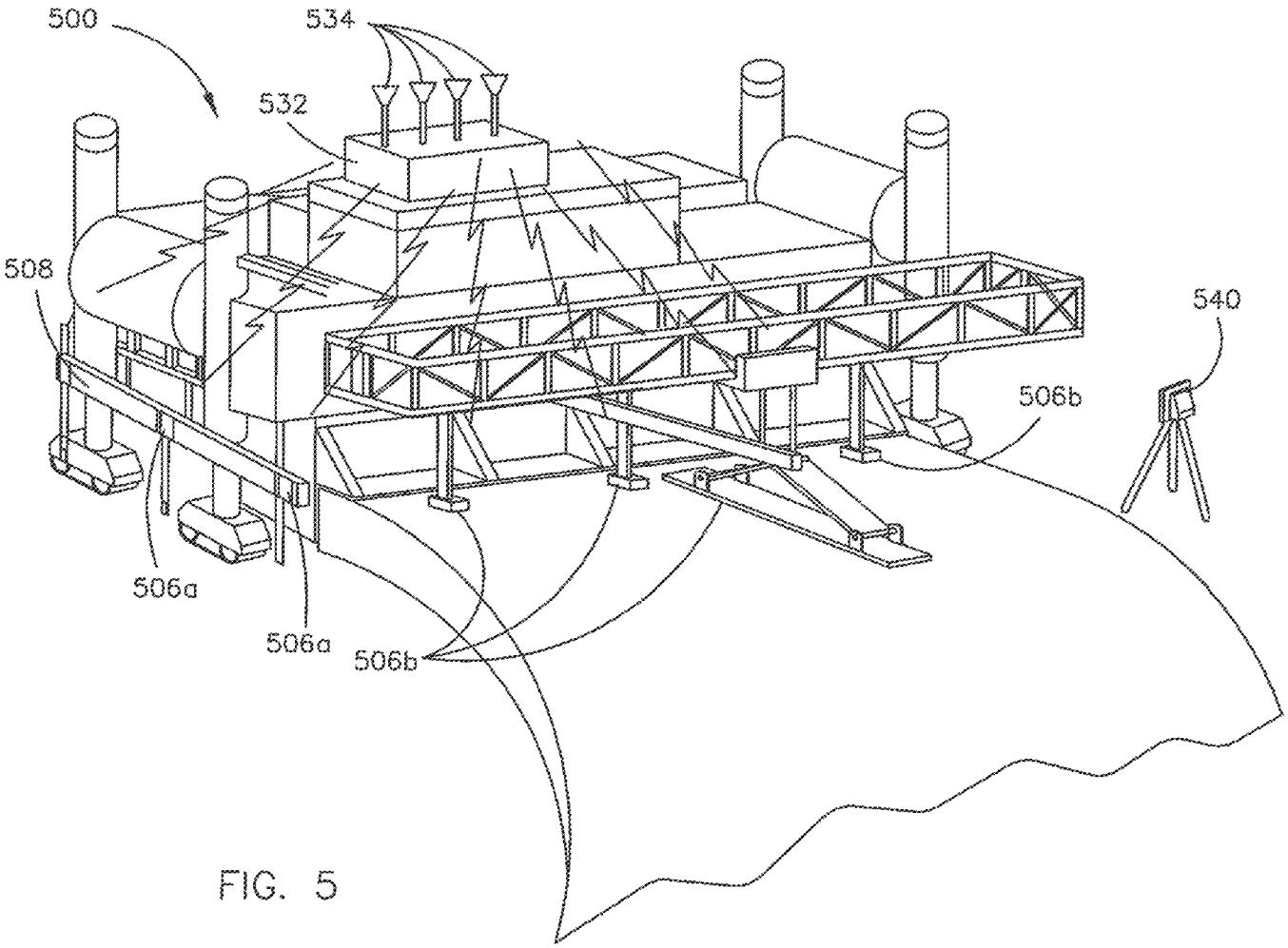
FIG. 5 shows a perspective view of an illustrative example of a multi-lift-cylinder (e.g., 4-track) paving machine according to embodiments of the present disclosure.

A desired paving profile, or some other data defining the desired movement and orientation of the machine (e.g., machine 200), may be stored in a data storage element also connected to the processor 338, potentially through the memory 337, or accessible to the processor 338 via a remote data connection such as through an external design data device (e.g., device 540 as depicted in FIG. 5). The external design data device may comprise a GPS or other 3D positioning system with its own sub-system of sensors, interface, and memory to store initial settings, machine dimensions, and the design data. The external design data device may broadcast or stream one or more values to the processor 338, including but not limited to, height (or depth) and elevation values, long slope values, cross-slope (e.g., individual lane cross-slope as with multi-lane paving using multiple powered transition adjusters) values, and lane width values (e.g., lane widths for individual lanes). In embodiments, the external design data device may broadcast or stream dynamic design dimensions, model dimensions, and real-time model dimensions (e.g., for machines with one or more dimensions that are adjustable during operation).

In embodiments, the MIMO control system 310 incorporates one or more communication, transmission, and reception interfaces 334. In embodiments, the MIMO control system utilizes the network communication connection means 336 and the one or more communication, transmission, and reception interfaces 334 to receive a vector of values (e.g., inputs) at one time and transmit a vector of values (e.g., outputs) at one time. In further embodiments, the MIMO control system 310 receives multiple vectors (e.g., two or more) of values at one time and transmits multiple vectors of values at one time. In embodiments, an interface 334 (e.g., A/B1) differs from another interface (e.g., A/B2, A/B3, A/B4 . . . A/Bn) by at least a CAN bus. In other words, although illustrated as separate modules, blocks or circuits, each interface 334 may share transmission medium components (e.g., a shared antenna array) with the exception of sharing at least the CAN bus for each interface 334. In further embodiments, an interface (e.g., A/B1) differs from another interface (e.g., A/B2, A/B3, A/B4 . . . A/Bn) by at least a CAN bus and an antenna. In other words, although illustrated as separate modules, blocks or circuits, each interface 334 may share transmission medium components (e.g., shared oscillator) with the exception of sharing at least the CAN bus and the antenna (i.e., or antenna array) for each interface 334. In embodiments, the MIMO control system 310 includes one or more user interfaces (e.g., user interface 400 and user interface 402), including a Gain Matrix Initialize user interface. In embodiments, the Gain Matrix Initialize user interface allows an operator to initialize the matrix of gain values that are used as inputs to the MIMO controller (e.g., controller 332) to generate proportional and coordinated outputs to the drive legs (e.g., legs 320) of a construction machine (e.g., paving machine 200).

In embodiments, the received multiple vectors of sensor values are received in response to a controlled manipulation. For example, the multi-lift-cylinder paving machine 200 may be initialized on a surface of substantially known dimensions (e.g., on a level surface). In this regard, the sensor readings of each drive leg 220 of the multi-lift-cylinder paving machine 200 when initialized (e.g., reading sensor values on the level surface) comprise sensor error values. For example, when a paving machine is on a level surface, theoretically, one or more sensors may have a null-point or zero reading. However, even when on a level surface the sensors may be reading one or more values greater or less than zero. In embodiments, these values greater or less than zero are sensor error values.

In embodiments, the readings from the sensors after a manipulation by a known/measured amount comprise sensor delta values (e.g., "ΔS" values) communicated as inputs to the MIMO controller. For example, the drive leg 220*a* may be manipulated by actuating the hydraulic lift cylinder 224*a* associated with the drive leg 220*a* according to a known/measured amount (e.g., leg stroke "d"), causing the drive leg 220*a* to lift the paving machine by amount d. After lifting the paving machine according to the known/measured amount d, each sensor (e.g., sensors 206, 306, or sensors associated with drive legs 220), or an array of sensors (e.g., 206*c*) associated with a controlled variable (e.g., front grade, rear grade, cross-slope, or left and right long-slope), will relay one or more readings to the MIMO control system (e.g., system 310).

Figure 4A:
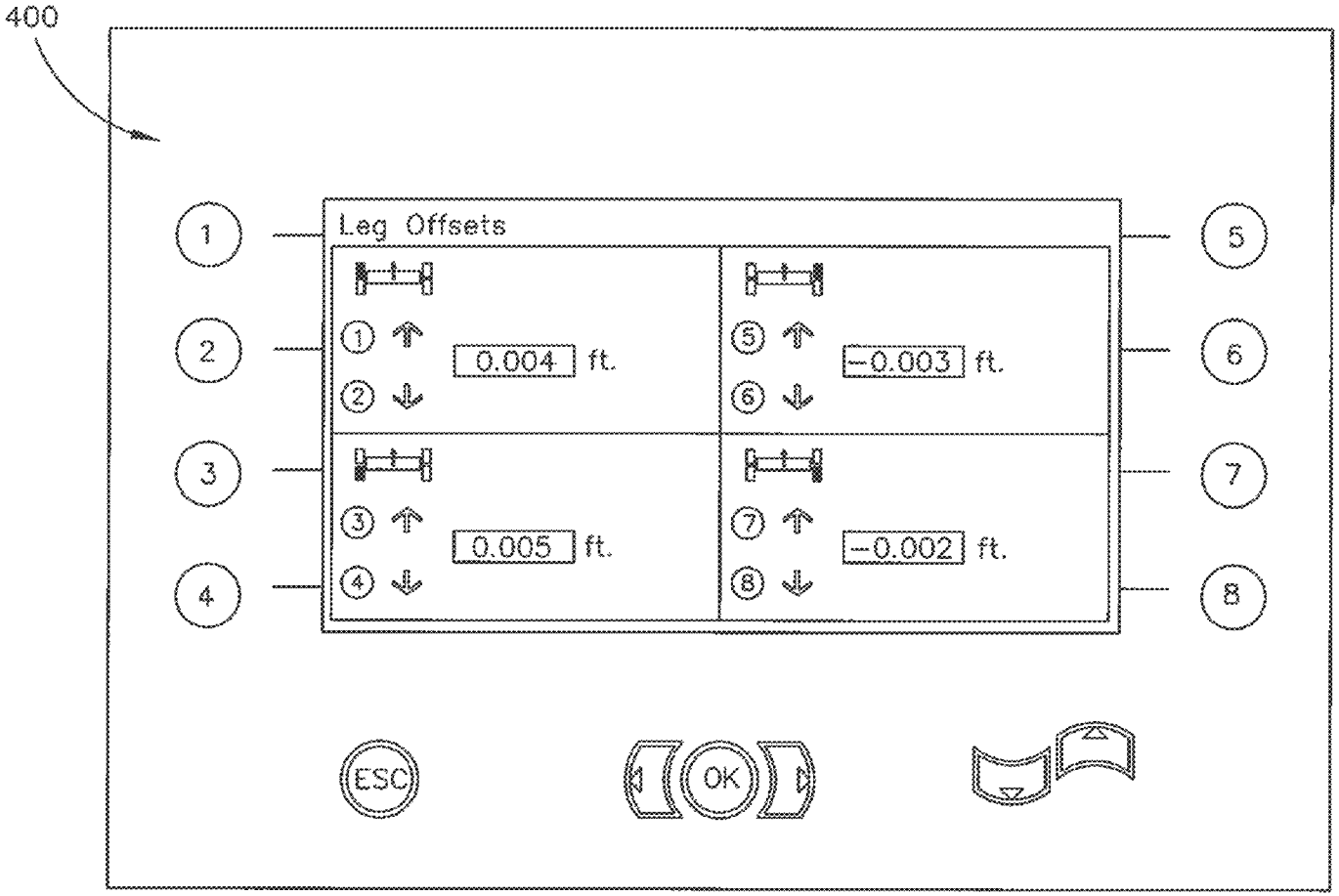
FIGS. 4A-4B show controller interfaces according to embodiments of the present disclosure.
Figure 4B:
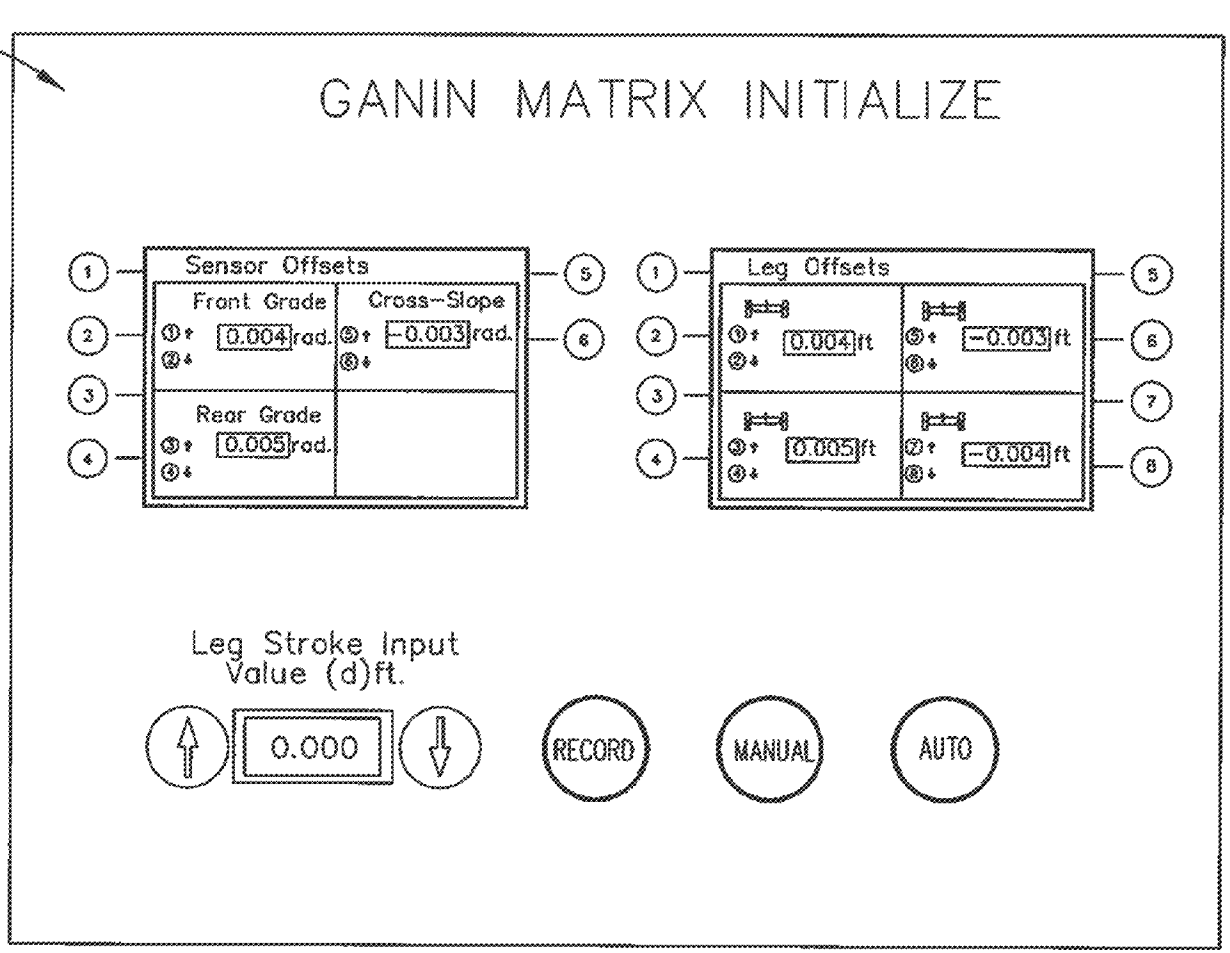

In embodiments, the terms "sensor delta values" and "sensor error values" are encompassed by the term "leg offsets." For example, in FIGS. 4A and 4B a user interface may be used to initialize the paving machine 200 (e.g., level cross-slope or make long-slopes equal). When initialized on a level surface, the "leg offsets" are proportional to leg sensor error values. When a reference drive leg is manipulated (e.g., as in method 600) the "leg offsets" are proportional to leg sensor delta values. In further embodiments, the terms "sensor delta values" and "sensor error values" are encompassed by the term "sensor offsets." For example, in FIG. 4B a user interface 402 may be used to initialize the paving machine 200. When initialized on a level surface, the "sensor offsets" are proportional to sensor error values (e.g., error of cross-slope or front/rear grade sensors). When a reference drive leg is manipulated (e.g., as in method 600) the "sensor offsets" are proportional to sensor delta values (e.g., delta values of cross-slope or front/rear grade sensors).

In embodiments, the MIMO control system receives one or more values from each of the different sensors (e.g., $S_1$, $S_2$, $S_3$ . . . $S_n$ and sensors associated with each drive leg) simultaneously as two or more vectors of values. In embodiments, the readings (e.g., sensor delta values "ΔS") received as two or more vectors of values, comprise the controller inputs (e.g., controller 232 or 532). During normal operation of the paving machine 200, if a drive leg 220*a* is adjusted to align the paving machine 200 to a predetermined path (e.g., grade), then each other drive leg (e.g., 220*b* and 220*c*) is manipulated simultaneously and proportionally according to one or more generated vectors of outputs. The one or more generated vectors of outputs are determined based on the controller inputs. The outputs are used to obtain one or more controlled variables (e.g., cross-slope).

In embodiments, each controlled variable can have any number of sensors 306 assigned to it. For example, as illustrated in FIG. 2B, the multi-lift-cylinder (e.g., 3-track) paving machine 200 has additional sensors (e.g., sensors 206*c*) distributed along the instruments rail 208*b*, which is attached to the machine frame above the extruding edge to further improve the machine average cross-slope accuracy. Each sensor of machine 200 is uniquely weighted. For example, the weight of a sensor may be determined based on a distance of the sensor from a pivot axis of the paving machine. For instance, a 3-track paving machine may have two or more grade sensors and a pivot axis corresponding to the two or more grade sensors (e.g., 206*a* and 206*b* of paving machine 200 may run along an axis shared by the grade sensors—see FIG. 10, the pivot axis running along the stringline) and a weight of cross-slope sensors would be equal to a distance from the center of each drive leg or each track (e.g., the distance from the stringline to the center of 1020*a*, 1020*b*, or 1020*c*).

In embodiments, the sensors are referred to as $S_1$, $S_2$, $S_3$ . . . $S_n$ to correspond to a front grade sensor, a rear grade sensor, a cross slope sensor, or other output sensor, respectively. It is noted that the use of $S_1$, $S_2$, $S_3$ . . . $S_n$ to refer to these sensors is not limiting in that each of $S_1$, $S_2$, $S_3$ . . . $S_n$ may refer to a group of sensors that contribute to a combined sensor reading (e.g., MIMO controller input) that is referred to as the front grade sensor reading, the rear grade sensor reading, a long slope reading, or the cross slope sensor reading. For example, as illustrated in FIG. 2B, sensor $S_3$, or 206*c*, comprises an array of three or more sensors to generate a cross-slope reading. In embodiments, the sensor readings are used to obtain the multiple vectors of gain values that are used to obtain the one or more outputs (e.g., lift) transmitted to one or more drive legs in order to obtain the controlled variable (e.g., cross-slope).

In embodiments, the sensor readings are sensor error values. In further embodiments, the sensor readings are sensor delta values. It is further noted that in embodiments where a group or an array of sensors each contribute to the sensor reading, each sensor contributing to that reading may be individually weighted and the combination of individual weights and individual sensor readings may be averaged to produce an average sensor reading (e.g., an average cross slope reading). A weighted average reading R for a particular instance o may be defined by:

$$R_o = \frac{1}{\sum_{j=1}^{n} (w_j)} * \sum_{j=1}^{n} (w_j s_j)$$

where w is the weight of a particular sensor j; s is an individual sensor reading; n is the total number of sensors for the output (e.g., average cross-slope sensor reading).

In embodiments, an input from the sensors (e.g., 206, 306, or 506) to the MIMO controller (e.g., 232, 332, or 532) includes two or more vectors of multiple sensor values (e.g., sensor delta values). Because manipulating (e.g., lifting) a drive leg will likely affect the sensor readings of one or more other sensors (e.g., sensor of another drive leg, the front grade sensor(s), rear grade sensor(s), or cross slope sensor(s)), the input values received by the MIMO controller (e.g., 232, 332, or 532) comprise multiple vectors of values to account for actuation reciprocity affecting the measurements of each of the various sensors (e.g., $S_1$, $S_2$, $S_3$ . . . $S_n$).

In embodiments, the MIMO controller inputs may be any real or virtual sensor measurements that represent deviations from a design surface. A real sensor directly measures and outputs a distance from a reference. Real sensors may include sonic sensors, rotary sensors, skis, laser receivers, stringline sensors or any other such physical sensory apparatus. Sensors may have a large dynamic range to allow for transitions to take place. In one example, a laser receiver with a total range of two feet may allow for a transition from the bottom to the top of the sensor's range and still properly read the transmitted laser beam.

Virtual sensors may include communicated signals from a 3D system. The interruption, inspection, and forwarding of some or all of the 3D corrections, along with the use of other sensors provides a user with substantial flexibility.

Figure 3B:
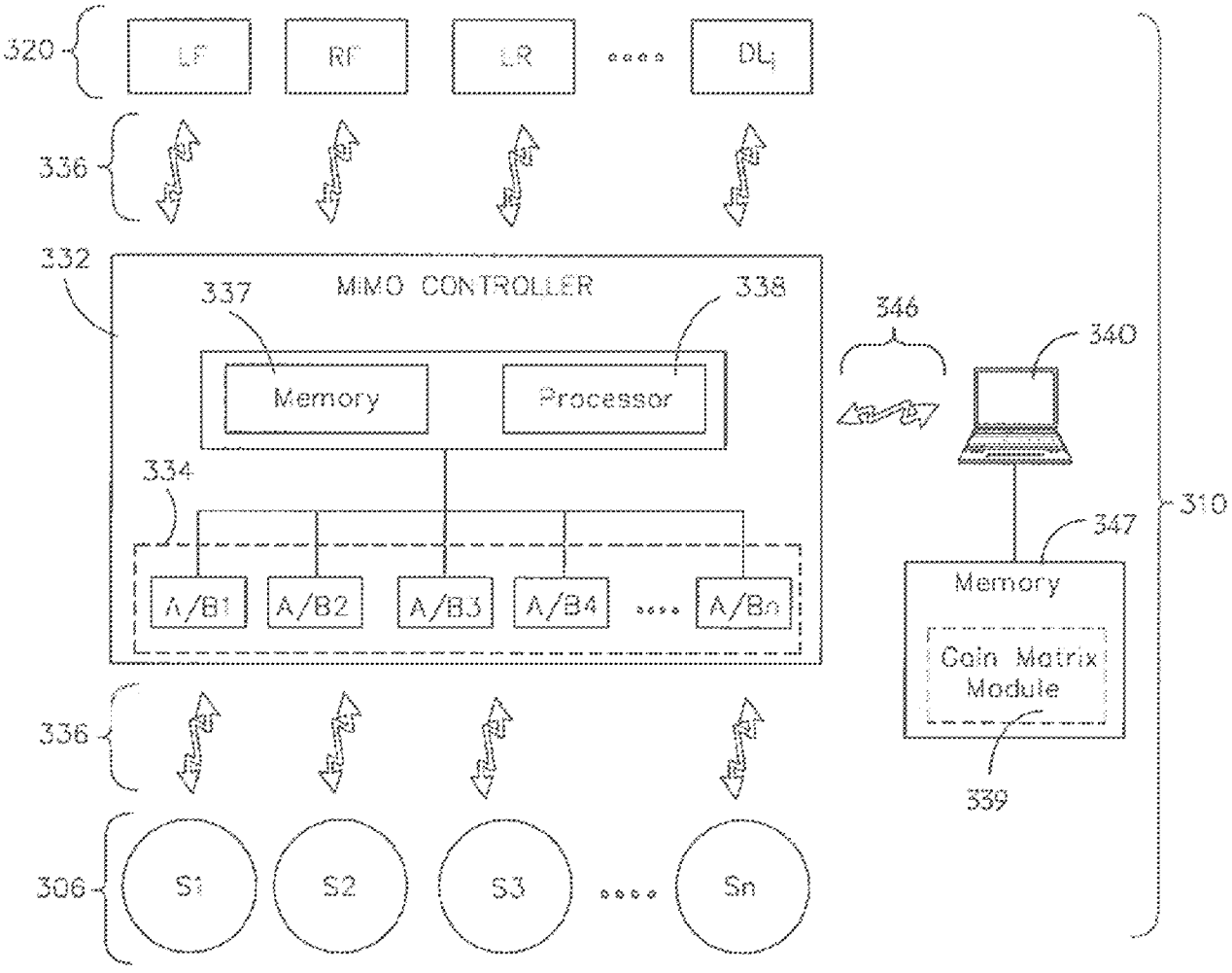

Referring to FIG. 3B, a block diagram of an embodiment of the MIMO control system 310 of the present disclosure is shown. In FIG. 3B, the gain matrix module 339 may be incorporated in a programmable computing device 340, such as a laptop computer, a personal desktop computer, or a multi-media device (e.g., smart phone) that is in communication 346 with the MIMO controller 332. In this regard, the programmable computing device may have one or more geometrical constraints or logical constraints associated with the paving machine (e.g., paving machine 200) stored in a memory 347 associated with the programmable device 340, or may have access to such geometrical constraints or logical constraints via a network connection 346 (e.g., closed area network (CAN) connection; local area network (LAN) connection, including WIFI; personal area network (PAN) connection, etc.). In this regard, the programmable computing device 340 may utilize the gain matrix initialize module 339 to calculate a gain matrix (G) according to the methods and embodiments of this disclosure and communicate the calculated gain matrix (G) to the MIMO controller 332. In embodiments, the network connection 346 is integrated within (e.g., utilizes the same network) network connection 336. In further embodiments, network connection 346 is a completely separate network connection (e.g., wireless internet connection) utilized to communicate the gain matrix G obtained via gain matrix module 339. In embodiments, the programmable computing device 340 also includes a multi-input-multi-output controller, similar to controller 332, with one or more communication, transmission, and reception interfaces 334 for simultaneous reception and transmission.

It is again noted that the use of a 3-track machine, as depicted in FIG. 2 is not limiting. For example, the machine may include any number of tracks with hydraulic lift cylinders associated with each track. For instance, FIG. 5 illustrates a 4-track paving machine 500 having a hydraulic lift cylinder associated with each of the four tracks. In further embodiments (not shown), paving machine 500 is a 4-track paving machine with m-hydraulic lift cylinders associated with each of the four tracks. In further embodiments, n (the number of sensors associated with each of the m-hydraulic lift cylinders) is greater than m (the number of hydraulic lift cylinders) resulting in an overdetermined solution (see Example 5).

In embodiments, paving machine 500 includes an array of sensors 506*a*, associated with the front grade and the rear grade. In embodiments, paving machine 500 has a MIMO control system (e.g., similar to control system 310) with a controller 532 having one or more communication, transmission, and reception interfaces 534 to receive two or more vectors of values for computing gain matrixes. Paving machine 500 includes an array of sensors 506*b* associated with the cross-slope controlled variable (e.g., an averaged cross-slope). In embodiments, paving machine 500 may also include an array of sensors 506*c* (not shown), which would be situated similar to sensors 506*a*, except sensors 506*c* would be positioned on the side of the paving machine 500 opposite of sensors 506*a*. In embodiments, paving machine 500 includes additional sonic sensors, rotary sensors, ski sensors, laser receivers, stringline sensors, or other physical sensory apparatuses to contribute to one or more of the controlled variables.

The embodiments of control system 310 illustrated in FIGS. 3A and 3B may be further configured as described herein. In addition, system 310 may be configured to perform any other step(s) of any of the method embodiment(s) described herein. The following method embodiments relate to simultaneous and proportional actuation of a multi-lift-cylinder machine in order to account for actuation reciprocity and geometrical sensor relativity, and to obtain a precise controlled variable using sensor readings (e.g., error values or ΔS values). It is generally recognized that system 310 is suitable for implementing the data processing level steps of the following embodiments. It is noted, however, the methods described below are not limited to the architecture of system 310.

Embodiments of the methods of the present disclosure may generally be described by comparing current PID controllers with a MIMO controller or a controller utilizing the PGC Inverse and/or MPC methods. For example, with a PID controller employing a single-input single-output (SISO) configuration, the gain matrix may be generally described as an identity matrix multiplied by gain values in relation to sensor input and controller output (e.g., to drive legs) by the following:

$$\begin{bmatrix} LF \\ LR \\ RF \\ RR \end{bmatrix} = \begin{bmatrix} g_{LF} & 0 & 0 & 0 \\ 0 & g_{LR} & 0 & 0 \\ 0 & 0 & g_{RF} & 0 \\ 0 & 0 & 0 & g_{RR} \end{bmatrix} \times \begin{bmatrix} S_1 \\ S_2 \\ S_3 \\ S_4 \end{bmatrix}$$

where $g_{xx}$ is the proportional gain for leg XX and $S_j$ is the sensor number j for a sensor or an array of sensors (e.g., grade, slope, 3D). This relationship with a 4×4 identity matrix would be applicable to a 4-track machine (e.g., a machine having a lift cylinder associated each of the four tracks, including, but not limited to, pavers, placers, spreaders, bridge rigs, etc.). It is noted that 4-track machines may have multiple lift cylinders associated with each track. This is also true of respective 3-track, 2-track, and t-track machines. As such may be the case, the number of matrix elements may increase with the number of lift cylinders associated with the machine. The number of matrix elements may also increase with the number of sensors contributing to the lift produced by a particular lift cylinder (e.g., as in overdetermined solutions—see Example 5).

In contrast, a machine having a controller employing a multi-input-multi-output (MIMO) configuration would result in a gain matrix (e.g., or a matrix of sensor correction values) generally described in relation to sensor input and controller output as follows:

$$\begin{bmatrix} LF \\ LR \\ RF \\ RR \end{bmatrix} = \begin{bmatrix} g_{LF1} & g_{LF2} & g_{LF3} & g_{LF4} \\ g_{LR1} & g_{LR2} & g_{LR3} & g_{RL4} \\ g_{RF1} & g_{RF2} & g_{RF3} & g_{RF4} \\ g_{RR1} & g_{RR2} & g_{RR3} & g_{RR4} \end{bmatrix} \times \begin{bmatrix} S_1 \\ S_2 \\ S_3 \\ S_4 \end{bmatrix}$$

The above relationships can be repeated for 3-track, 2-track, or t-track machines by decreasing and/or increasing rows and columns as follows:

3-track

*PID (SISO)*

$$\begin{bmatrix} LF \\ LR \\ RF \end{bmatrix} = \begin{bmatrix} g_{LF} & 0 & 0 \\ 0 & g_{LR} & 0 \\ 0 & 0 & g_{RF} \end{bmatrix} \times \begin{bmatrix} S_1 \\ S_2 \\ S_3 \end{bmatrix}$$

*MPC(MIMO)*

$$\begin{bmatrix} LF \\ LR \\ RF \end{bmatrix} = \begin{bmatrix} g_{LF1} & g_{LF2} & g_{LF3} \\ g_{LR1} & g_{LR2} & g_{LR3} \\ g_{RF1} & g_{RF2} & g_{RF3} \end{bmatrix} \times \begin{bmatrix} S_1 \\ S_2 \\ S_3 \end{bmatrix}$$

where $g_{xx}$ is the proportional gain for leg XX and $S_j$ is the sensor number j for a sensor or an array of sensors (e.g., grade, slope, 3D). This relationship with 3×3 matrices would be applicable to 3-track machines (e.g., a machines having a lift cylinder associated with each of the three tracks, including, but not limited to, curb and gutter pavers, barrier pavers, sidewalk pavers and trimmers, etc.).

2-track

PID (SISO)

$$\begin{bmatrix} LF \\ RF \end{bmatrix} = \begin{bmatrix} g_{LF} & 0 \\ 0 & g_{RF} \end{bmatrix} \times \begin{bmatrix} S_1 \\ S_2 \end{bmatrix}$$

MPC(MIMO)

$$\begin{bmatrix} LF \\ RF \end{bmatrix} = \begin{bmatrix} g_{LF1} & g_{LF2} \\ g_{RF1} & g_{RF2} \end{bmatrix} \times \begin{bmatrix} S_1 \\ S_2 \end{bmatrix}$$

where $g_{xx}$ is the proportional gain for leg XX and $S_j$ is the sensor number j for a sensor or an array of sensors (e.g., grade, slope, 3D). This relationship with 2×2 matrices would be applicable to 2-track machines (e.g., a machines having two lift cylinders, including, but not limited to, trimmers, finishers, bridge rigs, etc.).

t-track

PID (SISO)

$$\begin{bmatrix} LF \\ RF \\ \vdots \\ DL_i \end{bmatrix} = \begin{bmatrix} g_{LF} & 0 & \dots & 0 \\ 0 & g_{RF} & \dots & 0 \\ \vdots & \vdots & \vdots & \vdots \\ 0 & 0 & \dots & g_{DLi,j} \end{bmatrix} \times \begin{bmatrix} S_1 \\ S_2 \\ \vdots \\ S_j \end{bmatrix}$$

MPC(MIMO)

$$\begin{bmatrix} LF \\ RF \\ \vdots \\ DL_i \end{bmatrix} = \begin{bmatrix} g_{LF1} & g_{LF2} & \cdots & g_{LFj} \\ g_{RF1} & g_{RF2} & \cdots & g_{RFj} \\ \vdots & \vdots & \vdots & \vdots \\ g_{DL1} & g_{DL2} & \cdots & g_{DLi,j} \end{bmatrix} \times \begin{bmatrix} S_1 \\ S_2 \\ \vdots \\ S_j \end{bmatrix}$$

where $g_{xx}$ is the proportional gain for leg XX and $S_j$ is the sensor number j for a sensor or an array of sensors (e.g., grade, slope, 3D). This relationship with i×j matrices, where i and j are integer values from 1 to n and 1 to m respectively, would only result square matrices if the number of sensors n associated with the machine is equal to the number of lift cylinders m associated with the drive legs.

In embodiments, the MIMO control system is capable of providing an overdetermined solution. In this regard, the control system will have more sensors n providing inputs to the controller than lift cylinders associated with the drive legs m. In other words, the matrices determined in overdetermined embodiments are not square.

In embodiments, a MIMO control system (e.g., control system 310) is configured with a user interface (e.g., interface 400 and/or 402), allowing an operator to read a plurality of sensor values associated with a drive leg and/or associated with a controlled variable (e.g., cross-slope, average cross-slope, left long slope, right long slope, front grade, and rear grade). For example, a manipulation may occur at a drive leg of the multi-lift-cylinder machine and a plurality of sensor display values (e.g., sensor readings) may be visible to the operator as associated with a drive leg or a particular controlled variable (e.g., FIG. 4B). In embodiments, a MIMO controller 332 having a memory 337 and a processor 338 with programmed instructions (e.g., computer executable program code) is in communication with the sensors (e.g., $S_1$, $S_2$, $S_3$, through $S_n$) in order to generate the sensor display values or the delta S values. In embodiments, the delta S values are utilized as inputs to the MIMO controller 332 to generate a gain matrix (e.g., sensor correction values) and one or more outputs (e.g., leg stroke values) based on the gain matrix.

In embodiments, after generating the delta S values for an input, the delta S values are divided by a manipulation or actuation value (e.g., the known/measured leg stroke d). This division provides a gain value for a particular sensor (e.g., $S_1$, $S_2$, $S_3$ . . . $S_n$). Again, because there are multiple sensors, the gain values are input as two or more vectors of values, which are arranged into a matrix. The resulting relationship is expressed according to the following:

$$\Delta S = A * y$$

$$\begin{bmatrix} S_1 \\ S_2 \\ S_3 \end{bmatrix} = \begin{bmatrix} a_{LF1} & a_{LF2} & a_{LF3} \\ a_{LR1} & a_{LR2} & a_{LR3} \\ a_{RF1} & a_{RF2} & a_{RF3} \end{bmatrix} \times \begin{bmatrix} LF \\ LR \\ RF \end{bmatrix}$$

where ΔS is a vector of sensor readings for a sensor $S_j$, y represents actuation or movement at the particular drive leg to which the sensors are associated, and $a_{xj}$ is the gain for the sensor j for leg i. In further embodiments, $a_{xj}$ is the error for the sensor j for the controlled variable i. In this regard, the value that $a_{xj}$ represents will depend on the group of sensors being used to account for actuation reciprocity (e.g., using leg sensors other than the reference leg sensor; using controlled variable sensors such as cross-slope, front grade, or rear grade sensors; and/or using a combination of these sensors).

In overdetermined embodiments (e.g., where more sensors provide inputs to produce an output for a drive leg), the matrix A will not be a square matrix (See Example 5).

During normal operating conditions, the determination of the matrix A is not advantageous unless inversely applied to generate a vector of two or more output values. In embodiments, the vector of two or more output values is generated such that each value of the vector can be transmitted respectively to each drive leg. In embodiments, the vector of two or more output values is generated by communicating one or more sensor correction values to the MIMO controller (e.g., 332), which are accounted for (e.g., by multiplying a vector of sensor error values by the sensor correction values) before transmission of the vector of two or more output values. In embodiments, the transmission of outputs is done by the MIMO controller (e.g., 332) in order to produce manipulation, actuation, or lift at a drive leg. In further embodiments, the transmission of outputs is done by the MIMO controller (e.g., 332) in order to reduce or minimize the sensor error readings at each sensor (i.e., or array of sensors) associated with a controlled variable. To determine the output (e.g., y) provided to each drive leg, we use the opposite or inverse relationship of the relationship provided above (e.g., $A^{-1}*x=A^{-1}*A*y$). In embodiments, the opposite or inverse relationship is provided using a pseudo inverse (e.g., $A^{+}=A^{-1}*A*y$). In this regard, because if A is invertible, then $A^{+}=A^{-1}$. The remainder of the disclosure refers to the inverse of A as the pseudo inverse of A. In embodiments, the pseudo inverse of A is an array of gain values arranged in matrix form for use by the MIMO controller to actuate each leg according to the associated array of gain values. In further embodiments, the pseudo inverse of A is an array of sensor gain values to be transmitted to a sensor, or array of sensors, associated with a controlled variable. For example, this relationship is expressed according to the following:

$$y = G * \Delta S$$

-continued $$\begin{bmatrix} LF \\ LR \\ RF \end{bmatrix} = \begin{bmatrix} g_{LF1} & g_{LF2} & g_{LF3} \\ g_{LR1} & g_{LR2} & g_{LR3} \\ g_{RF1} & g_{RF2} & g_{RF3} \end{bmatrix} \times \begin{bmatrix} S_1 \\ S_2 \\ S_3 \end{bmatrix}$$

where $g_{ij}$ is the gain for leg i and for sensor j, where i and j are integer values from 1 to m and from 1 to n respectively. By way of another example, this relationship is expressed according to the following:

$$y = G * \Delta S$$

$$\begin{bmatrix} DLi_1 \\ DLi_2 \\ DLi_3 \end{bmatrix} = \begin{bmatrix} g_{S1Li1} & g_{S1Li2} & g_{S1Li3} \\ g_{S2Li1} & g_{S2Li2} & g_{S2Li3} \\ g_{S3Li1} & g_{S3Li2} & g_{S3Li3} \end{bmatrix} \times \begin{bmatrix} S_1 \\ S_2 \\ S_3 \end{bmatrix}$$

where $g_{ij}$ is the gain for sensor j (j=1, 2, 3 . . . n where S1 may be the front grade sensor, S2 may be the rear grade sensor, S3 may be the cross-slope sensor, etc.) with respect to drive leg i (i=LF (left front), RF (right front), etc., depending on the configuration of the machine). In embodiments, a drive leg may have more than one cylinder associated with it, such a relationship may be expressed according to the following:

$$y = G * \Delta S$$

$$\begin{bmatrix} cyl._1 \\ cyl._2 \\ cyl._3 \\ \vdots \\ cyl._m \end{bmatrix} = \begin{bmatrix} g_{S1,cyl\cdot 1} & g_{S1,cyl\cdot 2} & g_{S1,cyl\cdot 3} & \cdots & g_{S1,cyl\cdot m} \\ g_{S2,cyl\cdot 1} & g_{S2,cyl\cdot 2} & g_{S2,cyl\cdot 3} & \cdots & g_{S2,cyl\cdot m} \\ g_{S3,cyl\cdot 1} & g_{S3,cyl\cdot 2} & g_{S3,cyl\cdot 3} & \cdots & g_{S3,cyl\cdot m} \\ \vdots & \vdots & \vdots & \vdots & \vdots \\ g_{Sn,cyl\cdot 1} & g_{Sn,cyl\cdot 2} & g_{Sn,cyl\cdot 3} & \cdots & g_{Sn,cyl\cdot m} \end{bmatrix} \times \begin{bmatrix} S_1 \\ S_2 \\ S_3 \\ \vdots \\ S_n \end{bmatrix}$$

where $g_{ij}$ is the gain for cylinder i and for sensor j, where i and j are integer values from 1 to m and from 1 to n respectively.

Figure 6:
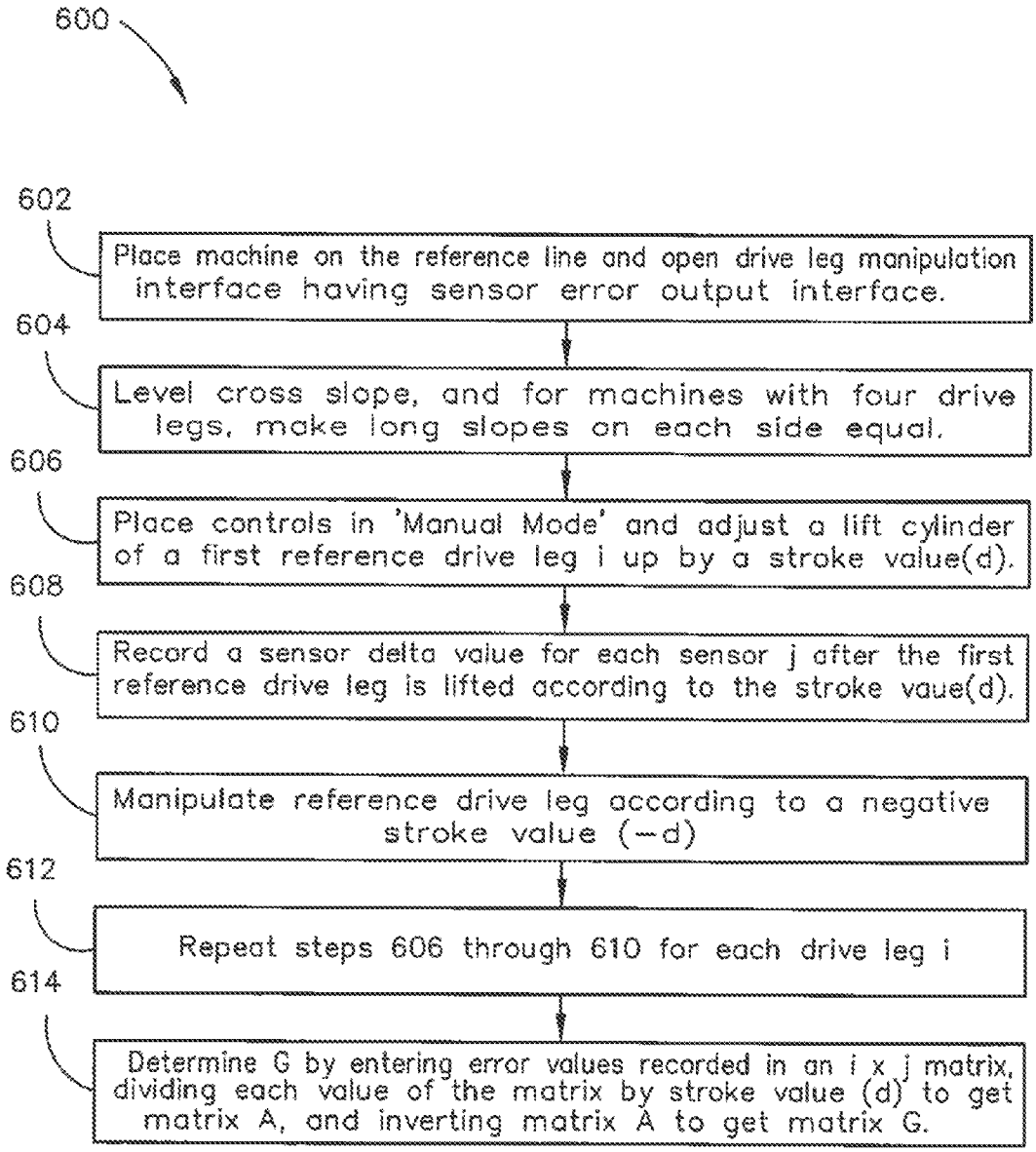
FIG. 6 shows a flow diagram according to embodiments depicting a method for manual calculation of a gain matrix G.

FIG. 6 illustrates a flow diagram depicting an Inverse method 600 for the synchronized movement of each drive leg of a multi-lift-cylinder paving machine. The synchronized movement produced is proportional to an output (e.g., controlled manipulation, actuation, or leg stroke) initially provided to one of the drive legs of the multi-lift-cylinder paving machine.

In step 602, the machine is placed according to one or more pre-determined reference positions. For example, the machine may be placed on a reference line (e.g., a stringline or a line indicated by 3D positioning). After the machine is in proper position, a drive leg manipulation interface (e.g., interface 402 as depicted in FIG. 4B) is initialized or opened by the operator. In embodiments, proper positioning includes placing the machine on a level surface.

In step 604, the controller of the machine is elevationally initialized or leveled. For example, the cross-slope variable is leveled by adjusting the drive legs until the sensors indicate that the cross-slope variable is level. In 4-track machine embodiments, the right and left long slope variables should be equal. Again, this is done by adjusting the drive legs until the sensor readings associated with the long slope variable of each side are equal.

Equalizing the long slope (e.g., matching long slope sensor readings of one side of the machine to another) is basically is a type of auto-level mode, where the grade side tries to bring both grade sensors to the same value (e.g. keep the grade side roughly parallel to the reference line/surface). The long slope on this side becomes the "Design" long slope when no external device (e.g., 540) is providing the "True Design Long Slope (pitch)."

For paver type machines the opposite side (slope side) tries to match this "Design" long slope. As the machine travels up/downhill the pitch of the machine stays consistent (left side stays equal to the right side).

In embodiments, sensor offsets and/or leg offsets can be applied to twist the machine (e.g., front side has different rise/fall than rear side and left side has different rise/fall than right side). In further embodiments, offsets are applied to un-twist a machine that might have been poorly calibrated (i.e., the slope sensors were not precisely aligned to the implement plane—where an implement for a paver may be the pan/mold).

In embodiments, the machine leveling/initializing is performed using an "auto-level" mode. Auto-level is one type of MIMO, with Long Slope Matching (e.g., equalizing both left and right long-slope) being implemented with a MIMO controller (e.g., controller 332).

In step 606, a controlled manipulation value is provided to a drive leg of the multi-lift-cylinder paving machine. In embodiments, the machine is placed in 'Manual Mode.' The controlled manipulation includes entering a leg stroke value (d) that causes a hydraulic valve to open and produce hydraulic lift at the drive leg. In embodiments, the MIMO controller may be placed in a manual mode using the Gain Matrix Initialize interface 400 such that the controlled manipulation is supplied by an operator using interface 400.

In step 608, the sensor delta values are recorded for each sensor associated with a drive leg and associated with each controlled variable. For example, after a controlled manipulation at a first drive leg of a multi-lift-cylinder machine, a sensor associated with the hydraulic lift of another drive leg may indicate a value different from its initialized or null-point value (e.g., the result of step 604). Additionally, the sensors associated with a controlled variable (e.g., cross-slope) may indicate a value different from its initialized or null-point value (e.g., the result of step 604). Accordingly, each sensor reading, or each reading from an array of sensors (e.g., an average reading) is recorded. In embodiments, the recording may be done via computational software including spreadsheet software, matrix software, or linear algebra software.

In step 610, the reference drive leg is manipulated according to a negative stroke value (−d). In other words, the reference drive leg is brought back to its initialized or null-point state.

In step 612, steps 606 to 610 are repeated for each drive leg of the multi-lift-cylinder machine. In embodiments, the multi-lift-cylinder machine is an m-cylinder machine with m cylinders associated with each drive leg, wherein m=n (# of sensors). In this regard, steps 606 to 610 would be repeated for each drive leg; (where i is from 1 to m). By way of another example, the m-cylinder machine may be a machine with m greater than n. In further embodiments, where n (# sensors) is greater than m (# lift cylinders), although steps 606 to 610 may be repeated, the steps are modified according to a least squares approach (see Example 5).

In step 614 the gain matrix G is determined. In order to determine G, two or more vectors of gain values are determined. The two or more vectors of gain values are determined by observing or reading sensor delta values as compared to the controlled manipulation. The gain values of each of the two or more vectors are calculated by dividing the sensor delta values by the controlled manipulation value (d). In embodiments, arranging the two or more vectors of gain values into a matrix will result in an i×j matrix A. Performing the recording of step 608 in computation software increases the speed at which the division of step 614 may be accomplished.

In embodiments, the result of the division in step 614 is a leg gain matrix A. In further embodiments, the result of the division in step 614 is a sensor error matrix A. The pseudo inverse of matrix A is then computed in order to determine gain matrix G (i.e., gain matrix G to minimize sensor error, and in further embodiments, gain matrix G to account for actuation reciprocity at each leg other than a reference leg)

In embodiments, certain steps of method 600 are performed by computational software embedded in the controller of the machine, by the processor of the controller (e.g., 232, 332, or 532), or by a processor of the gain matrix module 339.

In embodiments, the "Auto-level" mode may be a combination of manual and automatic. For example, when auto-leveling a 4-track machine (e.g., a machine with 4-tracks and one height adjustable cylinder per track), one leg (e.g., reference leg) of the machine may be kept in a manual mode to adjust according to a leg stroke (d). Then, the sensor error values of each of the cross-slope, left long-slope, and right long-slope sensors are automatically recorded in response to the leg stroke (d) at the reference leg. Using these three sensors (e.g., cross-slope, left long-slope, right long-slope) to control the remaining three legs, a square (e.g., 3×3) matrix A is obtainable. During operation, this matrix A is inverted to obtain the gain matrix G.

Figure 7:
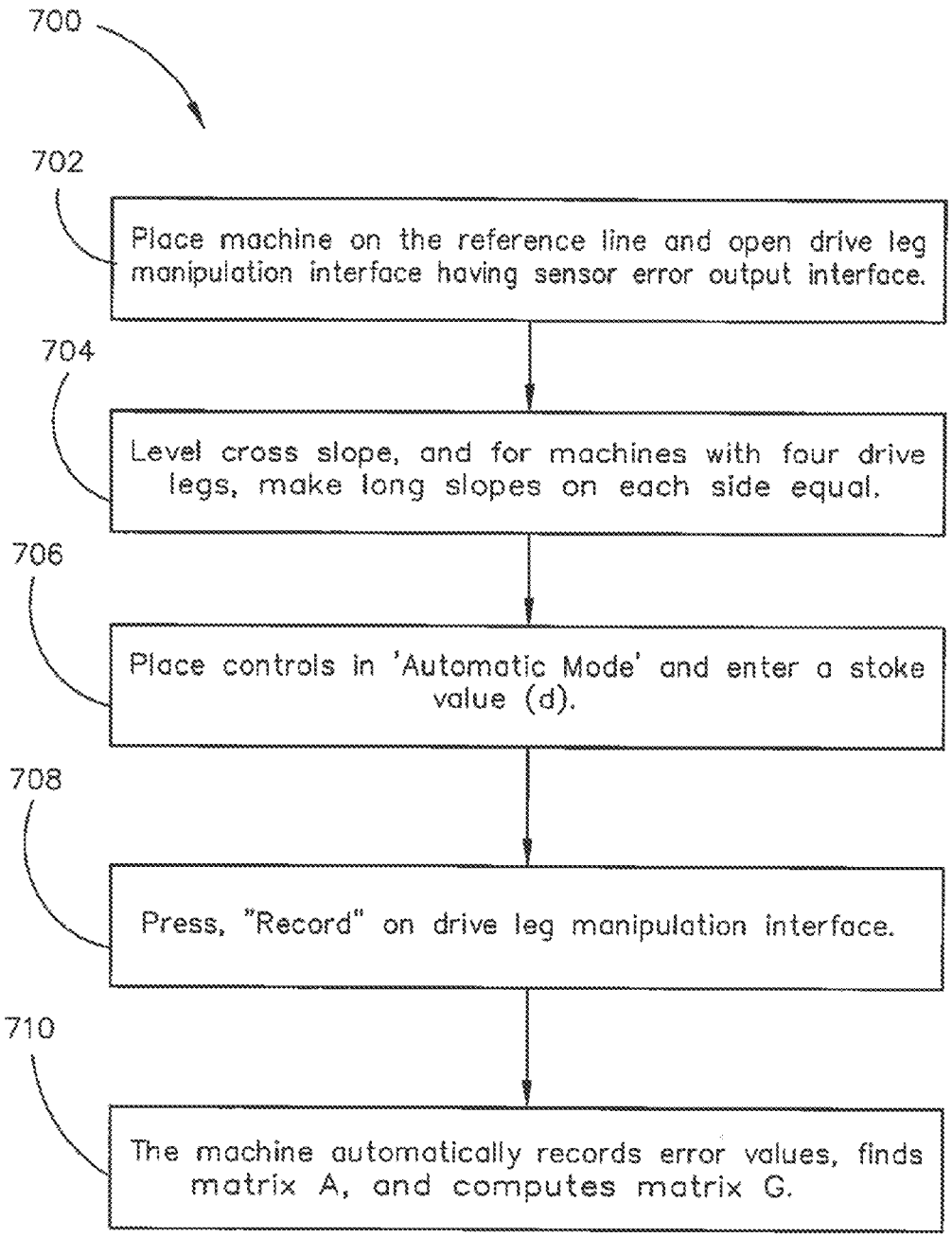
FIG. 7 shows a flow diagram according to embodiments depicting a method for automatic calculation of a gain matrix G.

In embodiments, the Quick Inverse method is utilized to determine the gain matrix G. For example, in FIG. 7 a method 700 using the Quick Inverse method to determine the gain matrix G is illustrated.

In step 702, the machine is placed according to one or more pre-determined reference positions. For example, the machine may be placed on a reference line (e.g., a stringline or a line indicated by 3D positioning).

In step 704, the controller of the machine is elevationally initialized, initialized for grade and slope, or leveled. For example, the cross-slope variable is leveled by adjusting the drive legs until the sensors indicate that the cross-slope variable is level. In 4-track machine embodiments, the right and left long slope variables should be equal.

In step 706, a user interface is accessed, such as the Gain Matrix Initialize interface of FIG. 4A or 4B, to place the controller in an "Automatic Mode." The interface may include one or more user input interfaces (e.g., touch screen, knob, button, etc.) including a "RECORD" button. By pressing the "RECORD" button after a stroke value (d) is entered, the recordings, computations, and additional manipulations of steps 608 to 612 are performed in step by the controller (e.g., controller 232, 332, or 532). In embodiments, the "RECORD" button is pressed prior to entering leg strok value (d) and the machine manipulates the drive legs according to a pre-programmed leg stroke value (d).

In embodiments, the computed vectors of gain values are associated by the controller with each drive leg (e.g., drive leg; where i=1, 2, 3, . . . m for an m-cylinder machine) or each controlled variable and are arranged in matrix form to obtain the matrix A of sensor values. In further embodiments, the computed vectors of gain values are associated by the controller with each sensor (e.g., $S_j$ where j=1, 2, 3, . . . n for n number of sensors) or each controlled variable and are arranged in matrix form to obtain the matrix G of gain values. In embodiments, matrix A is inverted using a pseudo inverse to determine the matrix of gain values G.

In embodiments, after the matrix of gain values (G) has been computed in "Automatic Mode," the controller may be further configured to be placed in "Manual Mode" in order to further manually adjust the computed matrix G of gain values. In this regard, the method still improves upon current PID controllers as the controller (e.g., 232, 332, or 532) has already been initialized to a group of gain values that should result in very accurate control (e.g., gain values of matrix G). Thus, the further manual adjustments should be minimized.

In embodiments, each drive leg of a multi-lift-cylinder machine incorporates a sensor to measure its own leg stroke such that manual measuring of the actual leg stroke is not required during re-tuning (e.g., determining the gains again after an adjustment to one or more of the machine dimensions).

Figure 8:
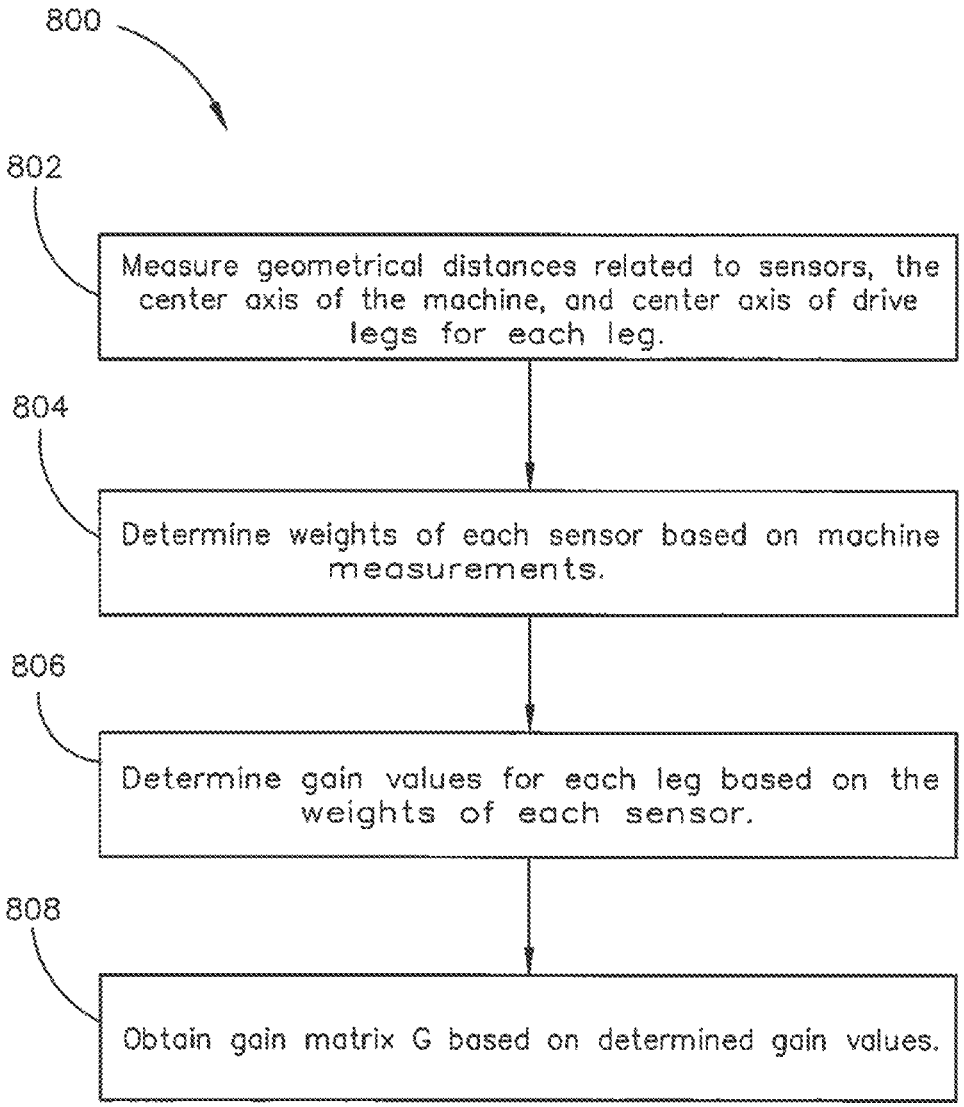
FIG. 8 shows a flow diagram according to embodiments depicting a Model Predictive Control (MPC) method for calculation of a gain matrix G.

In embodiments, certain steps of method 800 are performed using a MPC method. For example, in FIG. 8 a method 800 using the MPC method is illustrated.

In step 802, geometrical distances related to the machine and/or controlled variables are measured. In embodiments, the measurements are taken before operation. In further embodiments, the measurements are varied to a known and/or computed measurement during operation (e.g., machines width is expanded during operation—in this regard, the gain matrix G may be re-calculated). In embodiments, the distances measured include, but are not limited to, distances from the sensor pivot axis to the vertical-center axis of each leg, distances from the cross-slope sensors to the center axis of each leg, and distances from the center axis of each leg and front and rear grade sensors to a horizontal, center axis running through the front and rear ends of the machine.

It is noted that the geometrical distances necessary for the methods of this disclosure (e.g., MPC) will vary depending on the machine model. For example, smaller, rigid-body machines may not require the location of the cross-slope sensor to be measured so long as the sensor is stable and free from excessive vibration and accelerations. By way of another example, machines with non-rigid (flexing frames) will have more than one cross-slope sensor (e.g., one per side of the flexing frame). In this regard, the distance to cross-slope sensors may be measured to maintain the accuracy of the machine model and determined weight of the sensors.

In step 804, weights of each sensor are determined based on the geometrical machine measurements. For example, a rear grade sensor that is in line with the rear leg of the machine will rise and fall with any lift produced by the rear leg sensor, thus the front grade sensor may have or be given a negligible weight (i.e., the front grade sensor error has negligible impact on the rear grade sensor and so the front grade sensor is given negligible weight with respect to the rear grade sensor). A sensor that is positioned outside the geometrical distances of a drive leg (e.g., not in close proximity to the drive leg) may have to be given significant weight in order to account for the effect of actuation reciprocity on sensor readings at the outside sensor as compared to readings at a sensor that is in close proximity to a drive leg.

Figure 9:
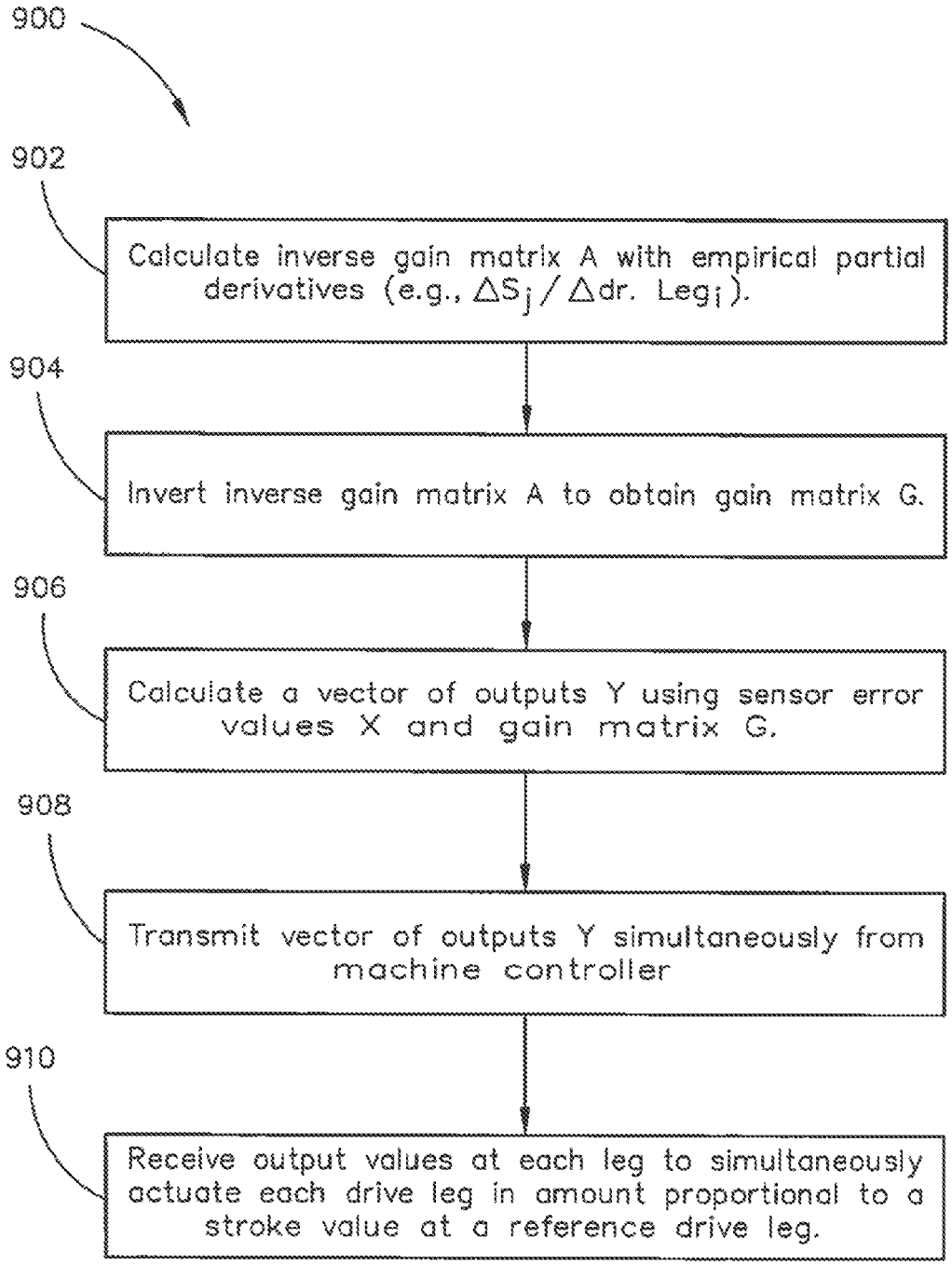
FIG. 9 shows a flow diagram according to embodiments depicting a method using empirical partial derivatives for calculation of a gain matrix G.

In embodiments, the controller in an automatic mode, or the operator obtaining results in a manual mode, obtain the matrix A (e.g., leg gain matrix or sensor error matrix) by determining the result of multiple partial derivatives. For example, in FIG. 9 a method 900 of determining the matrix A in order to determine the gain matrix G and by using partial derivatives is illustrated.

In embodiments, the gain matrix G is determined using two or more gain functions. Each gain function in the matrix of gain functions is a function of sensor output and actuation provided to the reference drive leg. A sensor gain function may be represented by the following equation:

$$a(y) = \frac{\partial x}{\partial y} \tag{1}$$

where x is the vector of sensor values being read at each sensor (e.g., $S_1$=Grade front error, $S_2$=Grade Rear Error, $S_3$=Cross slope Error), y is a vector of values representing manipulation, actuation, or lift at each of the drive legs (e.g., y=lift respectively applied to left front drive leg (LF), left rear drive leg (LR), and right front drive leg (RF)).

Thus for each drive leg and each sensor, equation (1) can be rewritten as follows:

$$a_{LF1} = \frac{\partial S_1}{\partial LF}$$

$$a_{LF2} = \frac{\partial S_1}{LR}$$

$$a_{LF3} = \frac{\partial S_1}{\partial RF}$$

$$\vdots$$

$$a_{dr\cdot leg\,i} = \frac{\partial S_j}{\partial dr\cdot leg_i}$$

The function to determine the Jacobian matrix of x=ψ(y) or y=ψ(x) (depending on the desired solution) is represented below:

$$x(n,1) = A(n,m) * y(m,1) \tag{2}$$

$$\begin{bmatrix} S_1 \\ S_2 \\ S_2 \\ \vdots \\ S_j \end{bmatrix} = \begin{bmatrix} \partial S_1/\partial LF & \partial S_1/\partial LR & \partial S_1/\partial RF & \dots & \partial S_1/\partial dr\cdot leg_i \\ \partial S_2/\partial LF & \partial S_2/\partial LR & \partial S_3/\partial RF & \dots & \partial S_2/\partial dr\cdot leg_i \\ \partial S_3/\partial LF & \partial S_3/\partial LR & \partial S_3/\partial RF & \dots & \partial S_3/\partial dr\cdot leg_i \\ \vdots & \vdots & \vdots & \vdots & \vdots \\ \partial S_j/\partial LF & \partial S_j/\partial LR & \partial S_j/\partial RF & \dots & \partial S_j/\partial dr\cdot leg_i \end{bmatrix} \times \begin{bmatrix} LF \\ LR \\ RF \\ \vdots \\ dr\cdot leg_i \end{bmatrix}$$

-continued $$y(m,1) = G(n,m) * x(n,1) \tag{3}$$

$$\begin{bmatrix} LF \\ LR \\ RF \\ \vdots \\ dr\cdot leg_i \end{bmatrix} = \begin{bmatrix} \partial LF/\partial S_1 & \partial LF/\partial S_2 & \partial LF/\partial S_3 & \dots & \partial LF/\partial S_j \\ \partial LR/\partial S_1 & \partial LR/\partial S_2 & \partial LR/\partial S_3 & \dots & \partial LR/\partial S_j \\ \partial RF/\partial S_1 & \partial RF/\partial S_2 & \partial RF/\partial S_3 & \dots & \partial RF/\partial S_j \\ \vdots & \vdots & \vdots & \vdots & \vdots \\ \partial dr\cdot leg_i/\partial S_1 & \partial dr\cdot leg_i/\partial S_2 & \partial dr\cdot leg_i/\partial S_3 & \dots & \partial dr\cdot leg_i/\partial S_j \end{bmatrix} \times \begin{bmatrix} S_1 \\ S_2 \\ S_2 \\ \vdots \\ S_j \end{bmatrix}$$

where i and j are integers with $$\prod_{0}^{n} i = (i+1)$$

and $$\prod_{0}^{m} j = (j+1).$$

It is useful to note that since y and x are vectors of scalar values, the resulting Jacobian matrix is either an m×1 matrix or an n×1 matrix (e.g., a vector of i values, with i being an integer from 1 to n, or a vector of j values, with j being from 1 to m). This Jacobian matrix is the sensor error values or the actuation vector, depending on which function is implemented.

Empirically, equations (1), (2) and (3) are represented by the following equations:

$$a(LF_1) = \frac{\Delta S_1}{\Delta LF} \tag{4}$$

$$a(LF_2) = \frac{\Delta S_1}{\Delta LR}$$

$$a(LF_3) = \frac{\Delta S_1}{\Delta RF}$$

$$\vdots$$

$$a(drive\ leg_i) = \frac{\Delta S_j}{\Delta drive\ leg_i}$$

$$x(n,1) = A(n,m) * y(m,1)$$

$$\begin{bmatrix} S_1 \\ S_2 \\ S_2 \\ \vdots \\ S_j \end{bmatrix} = \begin{bmatrix} \Delta S_1/\Delta LF & \Delta S_1/\Delta LR & \Delta S_1/\Delta RF & \dots & \Delta S_1/\Delta dr\cdot leg_i \\ \Delta S_2/\Delta LF & \Delta S_2/\Delta LR & \Delta S_3/\Delta RF & \dots & \Delta S_2/\Delta dr\cdot leg_i \\ \Delta S_3/\Delta LF & \Delta S_3/\Delta LR & \Delta S_3/\Delta RF & \dots & \Delta S_3/\Delta dr\cdot leg_i \\ \vdots & \vdots & \vdots & \vdots & \vdots \\ \Delta S_j/\Delta LF & \Delta S_j/\Delta LR & \Delta S_j/\Delta RF & \dots & \Delta S_j/\Delta dr\cdot leg_i \end{bmatrix} \times \begin{bmatrix} LF \\ LR \\ RF \\ \vdots \\ dr\cdot leg_i \end{bmatrix}$$

-continued $$g(S_{1,1}) = \frac{\Delta LF}{\Delta S_1} \quad (5)$$

$$g(S_{1,2}) = \frac{\Delta LF}{\Delta S_2}$$

$$g(S_{1,3}) = \frac{\Delta LF}{\Delta S_3}$$

$$\vdots$$

$$a(S_{1,j}) = \frac{\Delta LF}{\Delta S_j}$$

$$y(m, 1) = G(n, m) * x(n, 1)$$

$$\begin{bmatrix} LF \\ LR \\ RF \\ \vdots \\ dr \cdot leg_i \end{bmatrix} = \begin{bmatrix} \Delta LF/\Delta S_1 & \Delta LF/\Delta S_2 & \Delta LF/\Delta S_3 & \dots & \Delta LF/\Delta S_j \\ \Delta LR/\Delta S_1 & \Delta LR/\Delta S_2 & \Delta LR/\Delta S_3 & \dots & \Delta LR/\Delta S_j \\ \Delta RF/\Delta S_1 & \Delta RF/\Delta S_2 & \Delta RF/\Delta S_3 & \dots & \Delta RF/\Delta S_j \\ \vdots & \vdots & \vdots & \vdots & \vdots \\ \Delta dr \cdot leg_i/\Delta S_1 & \Delta dr \cdot leg_i/\Delta S_2 & \Delta dr \cdot leg_i/\Delta S_3 & \dots & \Delta dr \cdot leg_i/\Delta S_j \end{bmatrix} \times \begin{bmatrix} S_1 \\ S_2 \\ S_2 \\ \vdots \\ S_j \end{bmatrix}$$

Thus, in step 902, the matrix A is calculated using the empirical partial derivatives listed above. The empirical partial derivative must be calculated for each drive leg in relation to an associated sensor delta value (e.g., $\Delta S_j/\Delta dr.leg_i$).

Again, during machine operation, the interest lies in the inverse relationship (e.g., what are the optimal control outputs given the most current sensor data). Therefore, in step 904, the pseudo inverse of matrix A is determined. In other words, equation (2) (or empirical equation (4)) is inverted in order to obtain G (e.g., $G=A^+$).

In step 906, an output vector y is determined. The resulting matrix "G" is multiplied by a vector of sensor values x. The results of the multiplication are added together according to matrix multiplication rules in order to obtain output column vector y (e.g., see equation (5)). In embodiments, the output vector y includes at least one output value for each drive leg of the multi-lift-cylinder paving machine based on the vectors of sensor error values. The output vector is determined using the pseudo inverse of matrix A.

In embodiments, the output column vector y includes a controller output value to be supplied as an input to each drive leg. Accordingly, in step 908, each controller output value of the vector y is simultaneously transmitted from the machine controller (e.g., 332) to each corresponding hydraulic cylinder (e.g., cylinder 224 implemented within a drive leg 220).

In step 910, the respective transmitted output values are received. In embodiments, the output values are received at the drive legs as drive leg input (e.g., lift) values, resulting in synchronized movement between each of the drive legs. The synchronized movement produced accounts for actuation reciprocity and geometrical sensor relativity. In embodiments, the synchronized movement is proportional to an initial controlled manipulation (e.g., stroke value (d)) provided to a reference drive leg.

In embodiments, methods used to obtain the matrix G allows for the use of standard uncertainty propagation techniques. For example, uncertainty may be obtained for each sensor of each drive leg as a function of the sensor/drive leg configuration employed in the machine. For instance, the separation of the front grade sensor from the rear grade sensor may be seven feet (7 ft.) for measuring long-slope changes over long distances (e.g., see FIG. 11 and Example 2 below, where 1106*a* and 1106*b* are separated by a distance of approximately seven feet). In this regard, the left front leg deviation (LF) may be 0.100+/−0.029 ft.; the left rear (LR) leg deviation may be 0.100+/−0.010 ft.; and the right front (RF) deviation may be 0.100+/−0.021 ft. In embodiments, the sensors may be spaced according to a much smaller separation in order to measure slope changes over short distances. For example, sensors may be spaced having a two-foot radius configuration, where each sensor in the two-foot radius configuration is separated by 0.8 ft. In this regard, the left front leg deviation (LF) may be 0.100+/−0.058 ft.; the left rear (LR) leg deviation may be 0.100+/−0.015 ft.; and the right front (RF) deviation may be 0.100+/−0.034 ft. It is noted that the separation distances provided are merely for illustrative and explanatory purposes only. A person of skill in the art would be able to determine other sensor separations and deviations for determining uncertainty. It is further noted, that in some embodiments, machine sensor separation may change during operation due to a machine changing one or more of its dimensions during operation.

A controller (e.g., 232, 332, or 532) in automatic mode, may calculate the drive leg sensitivity as a function of the inverse of the leg standard deviation. For example, the relationship may be expressed as follows:

$$S_{DLi} \approx \frac{1}{\sigma_{DLi}}$$

where $S_{DLi}$ is the sensitivity of a particular drive leg i, $\sigma_{DLi}$ is the standard deviation for the drive leg i, and i is an integer from 1 to m. In embodiments where one or more machine dimensions change during operation, the gain matrix G is updated automatically and accordingly. Sensitivities may also be re-calculated or may change in accordance with the one or more changed dimensions.

In embodiments, although the leg sensitivities may be automatically adjusted, other sensor sensitivities may be adjusted by an operator in a 'Manual Mode' of a controller interface (e.g., interface 400 or 402). For example, sensors associated with controlled variables (e.g., $S_1$, $S_2$, $S_3$ . . . $S_n$) may require a degree of calibration and zeroing. For each sensor (e.g., $S_1$, $S_2$, $S_3$ . . . $S_n$) a center value is subtracted from an observed value. For cross-slope, this would be the value observed when the machine frame is leveled. However for a virtual sensor (3D) it will be its null point.

Once the data is centered about zero, it is scaled to a consistent unit base, such as millimeters or 1/1000th foot. Sensor (e.g., $S_1$, $S_2$, $S_3$ . . . $S_n$) deviation s for a particular sensor j may be defined by:

$$s_j = a_j * (l_j - z_j)$$

where a is sensitivity; l is the measurement, z is the zero value, and j is an integer from 1 to n.

The following examples are to be considered as illustrative in nature, and are not limiting in any way. The scope of the invention is that which is defined in the claims only.

Example 1

Figure 10:
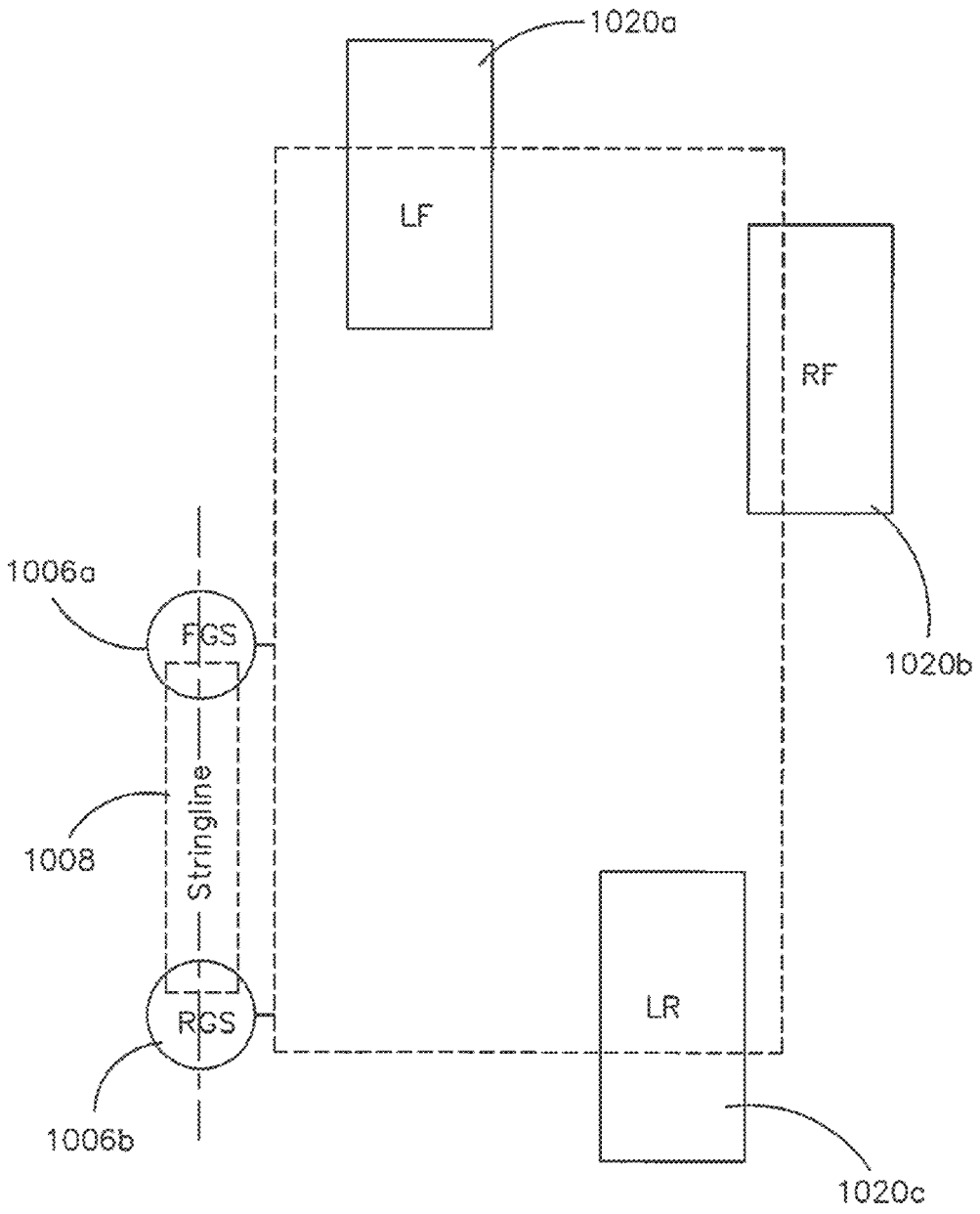
FIG. 10 shows a relational schematic in block diagram form illustrating the positional relativity of tracks of the drive legs and the front and rear grade sensors of a multi-lift-cylinder (e.g., 3-track) paving machine according to embodiments of the present disclosure.

A geometric construction of the matrix "G" was performed for a 3-track paving machine (e.g., GOMACO's GT-3600) (e.g., MPC method). FIG. 10 is a relational schematic in block diagram form illustrating the positional relativity of tracks of the drive legs and the front and rear grade sensors of the GT-3600 relative to a reference line (e.g., stringline).

The following geometrical values of Table 1, were obtained in order to construct matrix "G." The x values represent distances from the center of each leg (e.g., LR, RF, and LF) to the stringline (e.g., running through front grade sensor, FGS, and rear grade sensor, RGS), or to the sensor pivot axis. The y values represent distances from the paving implement edge (e.g., edge of interest, extruding edge, finishing edge, or apparatus edge).

TABLE 1

Geometrical values of front and rear grade sensors and drive legs of a GT-3600 in relation to stringline and measured control variable (e.g., cross-slope).

| | x | y |
|---|---|---|
| LF Leg | 3.0 | 11.5 |
| LR Leg | 6.5 | 0.0 |
| RF Leg | 8.5 | 9.0 |
| Front Grade | 0.0 | 5.0 |
| Rear Grade | 0.0 | 0.0 |

The matrix G provided below was constructed based on the geometrical values listed above.

$$G = \begin{bmatrix} 2.30 & -1.30 & 3.00 \\ 0.00 & 1.00 & 6.50 \\ 1.80 & -0.80 & 8.50 \end{bmatrix}$$

The cross slope gains (3.00 ft., 6.5 ft., and 8.5 ft.) are the distances from the center of each leg to the stringline (e.g., sensor pivot axis). Because the rear grade sensor is aligned with the rear leg, the front grade sensor does not influence it resulting in the zero value in the gain matrix. Because the front sensor is between the front two legs (e.g., 43% of the front to back distance) it needs to provide nearly twice the drive as the sensor error (e.g., 2.3=1/0.43), and would be weighted accordingly. The rear grade-side leg (e.g., left leg) does negatively influence the front sensor (e.g., −1.3=1−2.3). Thus, it would need to be weighted accordingly. If the left front leg is lifted by providing a gain value via the left front sensor, then the right front drive leg must immediately, or substantially simultaneously, be lifted 78% of the amount the left front was lifted (e.g., 0.78=9.0/11.5). Thus, it would be weighted accordingly. Because the front grade sensor is between the y-distance of the right front drive leg (e.g., by 56%), it will need to provide nearly twice the drive for a lift provided at the right front drive leg (e.g., given a weight of 1.8, where 1.8=1/0.56). The right-front drive leg does negatively influence the rear sensor (e.g., −0.8=1−1.8), and should be weighted accordingly.

Example 2

Figure 11:
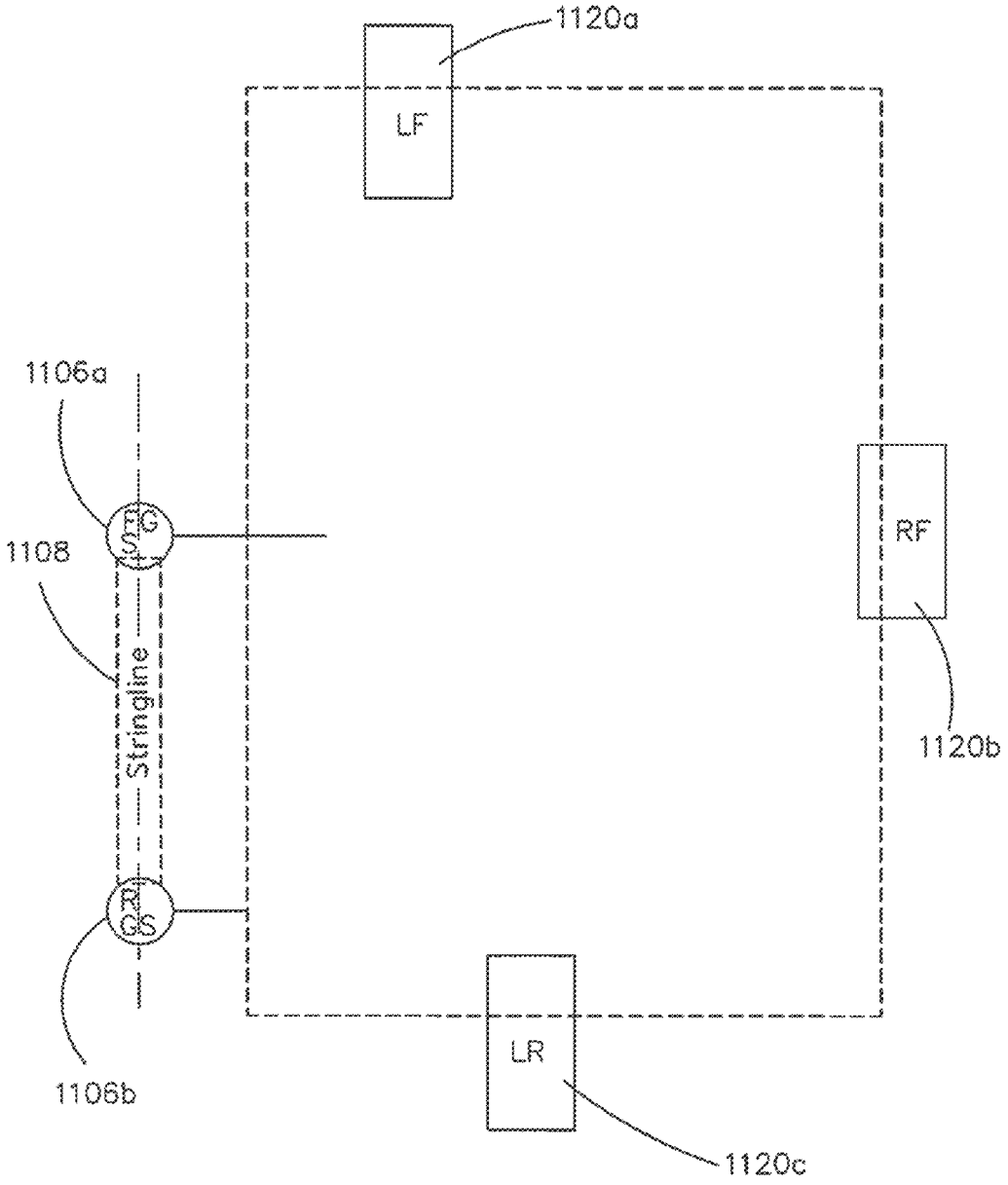
FIG. 11 shows a relational schematic in block diagram form illustrating the positional relativity of tracks of the drive legs and the front and rear grade sensors of a multi-lift-cylinder (e.g., 3-track) paving machine according to embodiments of the present disclosure.

A geometric construction of the matrix G was performed (e.g., MPC method) for a 3-track paving machine (e.g., GOMACO's Commander III). FIG. 11 is a relational schematic in block diagram form illustrating the positional relativity of tracks of the drive legs and the front and rear grade sensors of the 3-track Commander III relative to a reference line (e.g., stringline).

The following geometrical values of Table 2, were obtained in order to construct matrix G. The x-values represent distances from the center of each leg to the stringline, or to the sensor pivot axis. The y-values represent distances from the paving former (e.g., point at which cross-slope is measured). The stability of the configuration is indicated in Table 3.

TABLE 2

Geometrical values of front and rear grade sensors and drive legs of a GT-3600 in relation to stringline and measured control variable (e.g., cross-slope).

| | x | y |
|---|---|---|
| LF Leg | 4.00 | 14.10 |
| LR Leg | 6.20 | −2.40 |
| RF Leg | 13.10 | 7.90 |
| Front Grade | −1.00 | 7.00 |
| Rear Grade | −1.00 | 0.0 |
| Mold Point | 0.00 | 0.00 |

The matrix G provided below was constructed based on the geometrical values listed above.

$$G = \begin{bmatrix} 2.02 & -1.02 & 5.00 \\ -0.34 & 1.34 & 7.20 \\ 1.13 & -0.13 & 14.10 \end{bmatrix}$$

The cross slope gains (5.00 ft., 7.20 ft., and 14.10 ft.) are the distances from the center of each leg to the stringline (e.g., sensor pivot axis). Because the rear grade sensor is not aligned with the rear leg, the gain matrix will have no zeros (e.g., no decoupled outputs). Because the front sensor is between the front two legs (e.g., 49.6% of the front to back distance) it needs to provide nearly twice the drive as the sensor error (e.g., weight of 2.02, where 2.02=1/0.496). The rear grade-side leg (e.g., left leg) does negatively influence the front sensor (e.g., weight of −1.02, where −1.02=1−2.02). If the left front leg is lifted by providing a gain value via the left front sensor, then the right front drive leg must immediately, or substantially simultaneously, be lifted 56% of the amount the left front was lifted (e.g., given weight of 0.560, where 0.560=7.90/14.10). Because the front grade sensor is between the y-distance of the right front drive leg by only a small amount (e.g., by 89%), it will need to provide almost the same amount of lift at the right front drive leg (e.g., weight of 1.13, where 1.13=1/0.89). The right-front drive leg does negatively influence the rear sensor (e.g., −0.13=1−1.13).

Matrix A for this Example may also be calculated using a Quick Inverse method. Using a Quick Inverse method, matrix A below was determined.

$$A = \begin{bmatrix} 1.02 & 0.70 & -0.72 \\ 0.66 & 1.17 & -0.83 \\ -0.08 & -0.05 & 0.12 \end{bmatrix}$$

Using the pseudo inverse (e.g., computing $A^+$), the matrix G (provided above) is determined according to the Inverse methods of this disclosure.

TABLE 3

Stability of the geometrical configuration of the CIII (3-track) using matrix/linear algebra tools. Condition Numbers

| Singular values | Norm1 | NormInf | Norm For |
|---|---|---|---|
| 35 | 41 | 50 | 36 |

Stability (low = better)

In another case, with the CIII (4-track) paving machine, the machine was used to pave a 10 ft. wide path that transitioned to a 12 ft. path. During this run, there was one cross-slope transition in the lane being paved and one cross-slope transition in the adjoining lane (grade matching lane).

The leg lift equations (e.g., gain matrix (G)) resulting from this run were determined as follows.

The matrix (G) was determined using a quick inverse gain method:

$$G = \begin{bmatrix} 9 & 0 & -15 & -8 \\ 0 & 10 & -16 & 7 \\ 9 & 0 & -1 & 0 \\ 0 & 9 & -1 & -1 \end{bmatrix}$$

The matrix (G) was multiplied by sensor values associated with the four drive legs. The resulting leg lift equations for this run were as follows:

$$LF=9\times gF+0\times gR-15\times CS-8\times LS$$

$$LR=0\times gF+10\times gR-16\times CS+7\times LS$$

$$RF=9\times gF+0\times gR-1\times CS-0\times LS$$

$$RR=0\times gF+9\times gR-1\times CS-1\times LS$$

where gF is the front grade sensor, gR is the rear grade sensor, CS is the cross-slope sensor, and LS is the long-slope sensor.

Example 3

Figure 12:
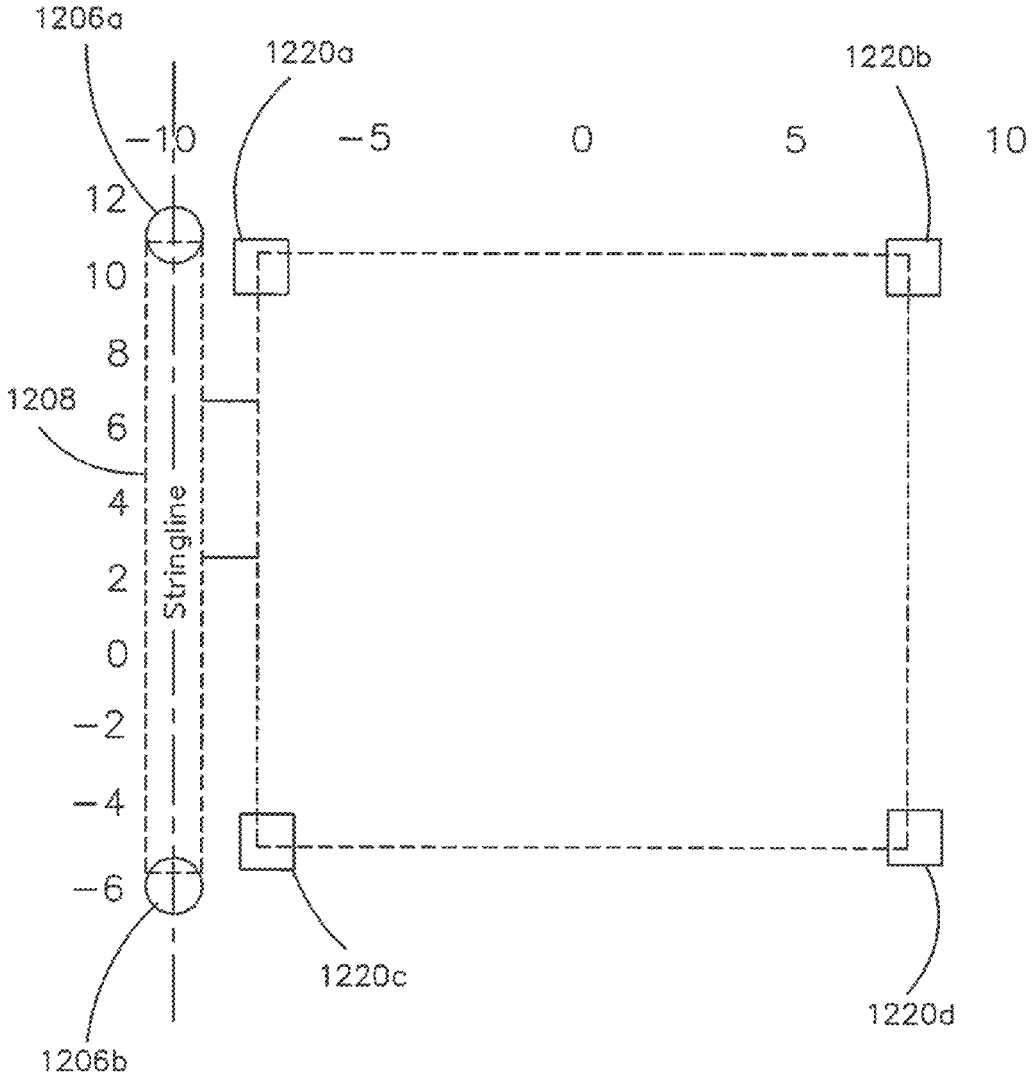
FIG. 12 shows a relational schematic in block diagram form illustrating the positional relativity of tracks of the drive legs and the front and rear grade sensors of a multi-lift-cylinder (e.g., 4-track) paving machine according to embodiments of the present disclosure.

A quick inverse gain method to obtain the matrix "G" was performed for a 4-track paving machine (e.g., GOMACO's Commander III). FIG. 12 is a relational schematic in block diagram form illustrating the positional relativity of tracks of the drive legs and the front and rear grade sensors of the 4-track Commander III relative to a reference line (e.g., stringline).

The following geometrical values of Table 4, were obtained in order to construct matrix G. The x-values represent distances from the center of each leg (e.g., LR, RF, and LF) to the stringline (e.g., running through front grade sensor, FGS, and rear grade sensor, RGS), or to the sensor pivot axis. The y-values represent distances from the paving former (e.g., blade or point at which cross-slope is measured).

TABLE 4

Geometrical values of front and rear grade sensors and drive legs of a Commander III in relation to stringline and measured control variable (e.g., cross-slope and/or long slope).

| Machine Coordinates | x | y |
|---|---|---|
| LF Leg | −7.6 | 10.2 |
| LR Leg | −7.5 | −5.0 |
| LR Leg | 7.8 | 10.2 |
| RF Leg | 7.8 | −4.9 |
| Front Grade Sensor | −9.3 | 10.9 |
| Rear Grade | −9.3 | −6.0 |

Individual perturbations were made to each drive leg with sensor error values being observed and recorded in order to use empirical partial derivatives to find inverse matrix A.

TABLE 5

Individual perturbations and observations recorded for a GOMACO Commander III.

| Observations | Units | LF + 0.2 ft. | LR + 0.2 ft. | RF + 0.2 ft. | RR + 0.2 ft. |
|---|---|---|---|---|---|
| gLF | ft. | 0.23 | 0.00 | −0.01 | −0.02 |
| gLR | ft. | 0.01 | 0.23 | −0.02 | 0.00 |
| $\Delta LS_{R\text{-}L}$ | %*10 | −0.120 | 0.114 | 0.114 | −0.113 |
| $\Delta CS_{AVG}$ | %*10 | −0.065 | −0.062 | 0.067 | 0.063 |

The inverse gain matrix A can be constructed from the empirical partial derivatives. The inverse matrix A from the observations of Table 5 is given as follows:

$$A = \begin{bmatrix} 1.15 & 0.00 & -0.05 & -0.10 \\ 0.05 & 1.15 & -0.10 & 0.00 \\ -0.60 & 0.57 & 0.57 & -0.57 \\ -0.33 & -0.31 & 0.34 & 0.32 \end{bmatrix}$$

The gain matrix G can be found by finding the inverse of A using mathematical algorithms or computational software such as MatLab, PLUS+1, Maple, or other computational software known in the art.

The gain matrix for the observations of Table 5 is given as follows:

$$G = \begin{bmatrix} 0.91 & 0.08 & -0.04 & 0.22 \\ 0.04 & 0.87 & 0.07 & 0.14 \\ 0.92 & 0.07 & 0.82 & 1.75 \\ 0.00 & 0.87 & -0.83 & 1.68 \end{bmatrix}$$

The steps required to obtain the gain matrix G are fewer than other examples or embodiments of the present disclosure. The reduction of steps helps reduce operator error, and may be achieved by reprogramming existing software to perform the necessary matrix computations.

It is useful to note that the sonic grade sensor error value (e.g., 0.23 for the left front sensor) is greater than the leg stroke value (d) (e.g., 0.2 ft. for this Example 3). This result can be explained by looking to the machine geometrical configuration as compared to the sensor position. With the Commander III, the left front sonic grade sensor is positioned at a greater distance along both the x- and y-axis than the left front leg. Thus, any perturbation, manipulation, or actuation at the left front drive leg will have to be compensated for at the left front grade sensor. This is done by scaling down, or giving the left front sensor a lower weight in the computation of drive leg outputs (e.g., gain value of 0.91 or 0.87 in the gain matrix G).

In Example 3, it is also observed that the long slope has little impact on the left (grade) side (e.g., with gain values being −0.04 and 0.07). As no zero values were observed with respect to the change in cross slope and the difference in long slope (right-left), it is concluded that any perturbation, manipulation, or actuation at a drive leg of the 4-track machine will necessarily result a compensating output value to be generated by the controller and communicated to corresponding drive legs.

In systems that fail to use the simultaneous compensating output values, a perturbation, manipulation, or actuation at a drive leg would result a non-compensated output (e.g., failing to account for actuation reciprocity). Thus, the output produced would be a false output. An advantage of methods of the present disclosure is the ability to reject (e.g., cancel out) false outputs to improve the overall stability, precision, and accuracy of the control variable (e.g., cross-slope or long slope of a desired grade).

It is also observed from Table 5, that a perturbation, manipulation, or actuation of a positive amount at the left rear leg will result correspondingly more at the right rear leg. This is an example of a feedforward coefficient because the result is to anticipate a future disturbance (e.g., at the right rear leg) and move both rear legs together according to their respective proportional amounts (e.g., gain values in matrix G) to hold the cross-slope.

Example 4

Figure 13:
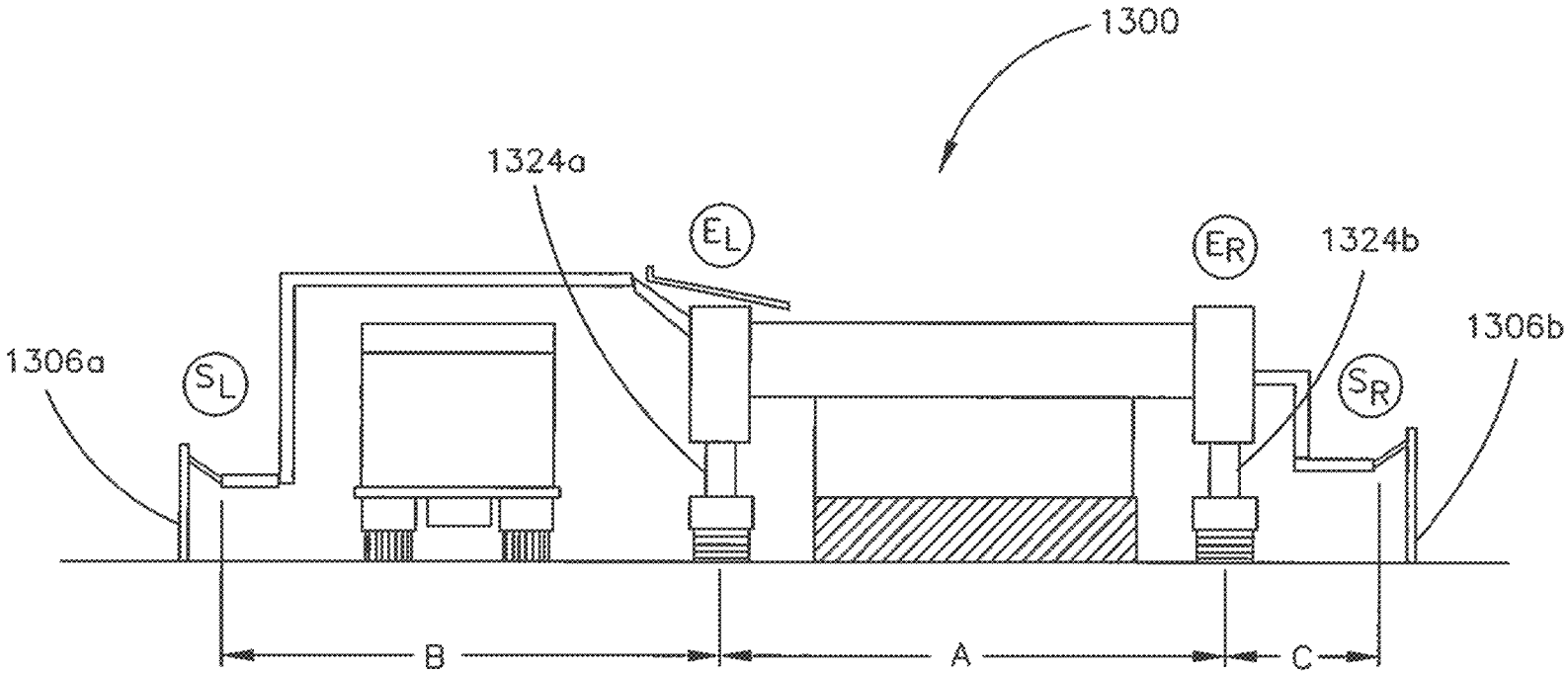
FIG. 13 shows a relational schematic of a multi-lift-cylinder paving machine (e.g., 2 elevation cylinders) with two tracks and with two grade sensors, one of which is attached to a gantry that spans a lane.

A model predictive control method (MPC) was performed on a two-dimensional paver (e.g., a paver with two elevation cylinders for controlling the rise and fall of the paver). Referring to FIG. 13, the paver 1300 has elevation cylinders 1324*a* and 1324*b*. The paver has grade sensors 1306*a* and 1306*b*. As illustrated in FIG. 13, 1306*a* is attached to a gantry that spans the length of a lane. Each elevation cylinder, 1324*a* and 1324*b*, is separated from the grade sensors 1306*a* and 1306*b* according to the distances shown (e.g., distances A, B, and C). The relationship of sensor error to lift produced at an elevation cylinder is given according to the following:

$$\begin{bmatrix} S_L \\ S_R \end{bmatrix} = \begin{bmatrix} \frac{B+A}{A} & -\frac{B}{A} \\ -\frac{C}{A} & \frac{C+A}{A} \end{bmatrix} \times \begin{bmatrix} E_L \\ E_R \end{bmatrix}$$

Thus, the matrix A is determined according to the following, where A=15 ft., B=15 ft., and C=3 ft.:

$$A = \begin{bmatrix} \frac{30}{15} & -\frac{15}{15} \\ -\frac{3}{15} & \frac{18}{15} \end{bmatrix} = \begin{bmatrix} 2 & -1 \\ -0.2 & 1.2 \end{bmatrix}$$

Then, matrix G can be determined according to the following:

$$G = A^{+} = \begin{bmatrix} 0.54 & 0.45 \\ 0.09 & 0.09 \end{bmatrix} \cong \begin{bmatrix} 1/2 & 1/2 \\ 0 & 1 \end{bmatrix}$$

In this Example, the sensor 1306*a* ($S_L$) may have a reading of 0.00 ft (e.g., no error), while sensor 1306*b* ($S_R$) may have a reading of 0.04 ft. (e.g., approx. ½ in.). Therefore:

$$E_L(1324a) = \frac{1}{2} \times 0 \text{ in.} + \frac{1}{2} \times \frac{1}{2} \text{ in.} = \frac{1}{4} \text{ in.}$$

$$E_R(1324b) = 0 \times 0 \text{ in.} + 1 \times \frac{1}{2} \text{ in.} = \frac{1}{2} \text{ in.}$$

In other words, in order to return both grade sensors to zero error, gain values need to be provided to the elevation cylinders. Specifically, cylinder 1324*a* ($E_L$) receives a gain value of ¼ in. and cylinder 1324*b* ($E_R$) receives a gain value of ½ in.

This Example illustrates the avoidance of a false negative output. For instance, if the system did not incorporation a MIMO controller, but instead relied on a single-input single-output (SISO) setup, then no drive would be supplied to the left leg, as illustrated by the following equations.

$$E_L(1324a) = 1 \times 0 \text{ in.} + 0 \times \frac{1}{2} \text{ in.} = 0 \text{ in.}$$

$$E_R(1324b) = 0 \times 0 \text{ in.} + 1 \times \frac{1}{2} \text{ in.} = \frac{1}{2} \text{ in.}$$

Example 5

In this Example, relationships are provided for determining a gain matrix G for cases where matrix A is not square. When determining the gain matrix G for an overdetermined MIMO controller (e.g., number of sensors measuring inputs is greater than the number of drive legs for which outputs are produced), the matrix A may be given according to the following (number of legs, m=4, and number of sensors, n=6):

$$A_{n,m} = \begin{bmatrix} a_{1,1} & a_{1,2} & \dots & a_{1,4} \\ a_{2,1} & a_{2,2} & \dots & a_{2,4} \\ \vdots & \vdots & & \vdots \\ a_{6,1} & a_{6,2} & \dots & a_{6,4} \end{bmatrix}$$

In this case, more than one solution exists (e.g., multiple leg actuations will satisfy returning some of the sensors to zero). Also, a single "least squares" solution exists that minimizes/reduces the error of the sensors. Sensors will be weighted using the inverse of a covariance matrix in order to take the inverse of the matrix A and find the gain matrix G. For instance, when $W_{x,x}=\Sigma^{-1}_{x,x}$ (covariance matrix), in this case $W_{m,m}=\Sigma^{-1}_{m,m}$.

As provided above, the relationship of sensor error to leg actuation is given according to the following equation:

$$x_{n,1}=A_{n,m}*y_{m,1}$$

Thus, the pseudo inverse (also provided above) becomes:

$$y_{m,1}=A^{+}_{n,m}*x_{n,1}$$

And with weighted sensors the pseudo inverse becomes:

$$A^{+}=(A^{T}WA)^{-1}*A^{T}W$$

Because sensor data can include several error values, minimizing/reducing the sensor error such that false positives are avoided can be obtained through several solutions, instead of one unique solution (e.g., as with embodiments using a square matrix A). Thus an overdetermined solution, requires a "Least Squares" estimate to provide the optimal leg drives.

The combined weighted normal equations and matrix A can be combined to form a general inverse (pseudo-inverse) that minimizes the sum of the squared sensor errors.

Although this is a more complicated system than one with the number of sensors matching the number of legs, it includes redundant measurements and also permits outlier detection. This is beneficial in further preventing bad sensor data throughout the system by checking multiple solutions (bootstrapping) or other statistical tools that would not otherwise be available when calculating gain matrix G using a square matrix A. Another benefit includes allowing error (uncertainty) propagation techniques to supply the user with estimated accuracy of sensors, legs, and point of interest (i.e. extruding edge).

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A control system comprising:

a plurality of sensors coupled to a heavy equipment machine having two or more height-adjusting cylinders; and a multi-input-multi-output (MIMO) controller, said MIMO controller having a processor communicatively coupled to said plurality of sensors and to said two or more height-adjusting cylinders, said processor having a memory with one or more programmable instructions executable by said processor to:

obtain a sensor value for each sensor or a set of sensors of the plurality of sensors;

determine a gain matrix (G) using a plurality of sensor correction values;

determine a vector of controller outputs for use as actuation inputs for each height-adjusting cylinder based on said gain matrix of said plurality of sensor correction values; and transmit simultaneously each value of the vector of controller outputs to each height-adjusting cylinder to result respective actuation at each height-adjusting cylinder, wherein respective actuation at each height-adjusting cylinder results in a synchronously controlled variable, said synchronously controlled variable including at least one of: cross-slope, right long-slope, left long-slope, or elevation.

2. The system of claim 1, wherein determine said gain matrix (G) using said plurality of sensor correction values comprises:

arranging said plurality of sensor correction values into a matrix (A);

inverting said matrix (A) to form said gain matrix (G), wherein determine said vector of controller outputs for use as actuation inputs includes multiplying said gain matrix (G) with a second plurality of sensor values obtained during operation.

3. The system of claim 2, wherein said one or more programmable instructions are further executable by said processor to:

allow an operator to adjust or set said plurality of sensor correction values.

4. The system of claim 1, wherein determine said gain matrix (G) using said plurality of sensor correction values includes manipulating a reference height-adjusting cylinder according to a known amount, wherein respective actuation at each height-adjusting cylinder is proportional to said known amount.

5. The system of claim 4, wherein said known amount comprises a leg stroke value (d), and wherein said manipulating said reference height-adjusting cylinder according to said known amount comprises:

(i) recording a sensor delta value for each sensor or set of sensors of the plurality of sensors that results from manipulation by the leg stroke (d);

(ii) dividing each sensor delta value by the leg stroke (d);

(iii) manipulating said reference height-adjusting cylinder by a negative leg stroke value (−d); and (iv) repeating steps (i) through (iii) for at least a second reference hydraulic cylinder.

6. The system of claim 1, wherein the one or more programmable instructions executable by said processor are further configured to:

obtain a design profile in order to determine a path to be followed; and detect a deviation from said design profile, wherein transmitting simultaneously each value of the vector of controller outputs to each height-adjusting cylinder further results maintaining the path to be followed.

7. The system of claim 1, wherein said MIMO controller comprises one or more transmission and reception interfaces for simultaneously receiving each value of the plurality of sensor values and for simultaneously transmitting each value of the vector of controller outputs, wherein a transmission and reception interface of said one or more transmission and reception interfaces includes a controlled area network (CAN) connection to operably connect said controller, said plurality of sensors, and said two or more height-adjusting cylinders.

8. The system of claim 7, wherein said controller has a plurality of transmission and reception interfaces, each transmission and reception interface of the plurality of transmission and reception interfaces being separated from another transmission and reception interface by at least a controller area network (CAN) bus.

9. The system of claim 1, wherein determine said gain matrix (G) using said plurality of sensor correction values comprises weighting each sensor value of the sensor or the set of sensors of the plurality of sensors according to one or more geometrical constraints.

10. The system of claim 7, wherein said geometrical constraints are dynamically determined.

11. The system of claim 1, wherein said heavy equipment machine is a paving machine, and wherein said MIMO controller is a programmable computing device in communication with a second multi-input-multi-output (MIMO) controller, said second MIMO controller directly connected to the paving machine and said MIMO controller being physically separate from said second MIMO controller.

12. A method for predictive grade control comprising:
obtaining a plurality of controller inputs;
determining a plurality of sensor correction values for a plurality of sensors based on said controller inputs;
determining a vector of controller outputs based on said plurality of sensor correction values; and
transmitting simultaneously each value of the vector of controller outputs to each height adjustable drive leg of an heavy equipment machine having a plurality of height adjustable drive legs to account for sensor error associated with a sensor of said plurality of sensors,
wherein the transmitting simultaneously to each height adjustable drive leg results in a synchronously controlled cross-slope, right long-slope, left long-slope, long-slope or elevation of the heavy equipment machine.

13. The method of claim 12, wherein obtaining a plurality of controller inputs comprises:
obtaining geometrical constraints of the heavy equipment machine including geometrical drive leg position of each drive leg of said plurality of height adjustable drive legs and geometrical position of each sensor of said plurality of sensors, wherein the plurality of sensor correction values are derived from said geometrical constraints.

14. The method of claim 13, wherein obtaining geometrical constraints comprises: obtaining first geometrical distances of the plurality sensors from a pivot axis of the heavy equipment machine; and obtaining second geometrical distances of the plurality of height adjustable drive legs from the pivot axis of the heavy equipment machine.

15. The method of claim 14, wherein deriving the plurality of sensor correction values from said geometrical constraints comprises determining a unique weight for each sensor of the plurality sensors based on the first and second geometrical distances and arranging the unique weight of each sensor into a sensor correction matrix (A), and wherein determining the vector of controller outputs includes inverting the sensor correction matrix (A) to form a gain matrix (G) and multiplying said gain matrix (G) by a vector of sensor values each loop the controller makes.

16. The method of claim 12, wherein obtaining a plurality of controller inputs comprises:
obtaining a plurality of sensor values from the plurality of sensors in response to a controlled manipulation value at a reference drive leg of the plurality of height adjustable drive legs, wherein determining a plurality of sensor correction values for a plurality of sensors comprises dividing each value of the plurality of sensor values by the controlled manipulation value to obtain a matrix (A) of sensor correction values, and wherein determining a vector of controller outputs comprises inverting said matrix (A) of sensor correction values to obtain a gain matrix (G) of sensor gain values and multiplying said matrix (G) by a vector of a second plurality of sensor values obtained during operation.

17. The method of claim 12, further comprising:
determining a path to be followed; and
detecting one or more deviations from the path to be followed, wherein transmitting simultaneously each value of the vector of controller outputs results maintaining the path to be followed.

18. A construction machine comprising:
a plurality of sensors coupled to two or more elevation cylinders; and
a multi-input-multi-output (MIMO) controller, said MIMO controller having a processor communicatively coupled to said plurality of sensors and to said two or more elevation cylinders, said processor having a memory with one or more programmable instructions executable by said processor to:
determine a path to be followed;
detect one or more deviations from the path to be followed;
obtain a gain matrix (G) based on unique weights given to said plurality of sensors; and
determine a vector of controller outputs to simultaneously actuate or restrain actuation at each elevation cylinder of the two or more elevation cylinders,
wherein the simultaneous lift at each elevation cylinder results in a synchronously controlled cross-slope, right long-slope, left long-slope, long-slope or elevation of the construction machine to return the construction machine to the path to be followed.

19. The construction machine of claim 18, wherein obtain said gain matrix (G) based on unique weights given to said plurality of sensors comprises:
obtaining first geometrical distances of the plurality of sensors and second geometrical distances of the two or more elevation cylinders from a pivot axis of the construction machine;
determining each unique weight of the unique weights given to said plurality of sensors based on the first and second geometrical distances;
determining a gain value for each sensor of said plurality of sensors based on each unique weight of the plurality of uniquely weighted sensors; and
arranging each gain value for each sensor into a matrix of gain values to be multiplied with a vector of sensor values obtained during operation for each loop the MIMO controller makes.

20. The method of claim 18, wherein obtaining said gain matrix (G) based on said plurality of uniquely weighted sensors comprises:
calculating a matrix (A) using two or more vectors of empirical partial derivatives; and
inverting said matrix (A).

* * * * *